US007195126B2

(12) United States Patent
Maruyama

(10) Patent No.: US 7,195,126 B2
(45) Date of Patent: Mar. 27, 2007

(54) SELF-PROPELLED WORKING MACHINE

(75) Inventor: Katsuya Maruyama, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 119 days.

(21) Appl. No.: 10/490,204

(22) PCT Filed: Sep. 27, 2002

(86) PCT No.: PCT/JP02/10126

§ 371 (c)(1),
(2), (4) Date: Mar. 29, 2004

(87) PCT Pub. No.: WO03/029126

PCT Pub. Date: Apr. 10, 2003

(65) Prior Publication Data

US 2004/0256343 A1 Dec. 23, 2004

(30) Foreign Application Priority Data

| | | |
|---|---|---|
| Sep. 28, 2001 | (JP) | 2001-302382 |
| Sep. 28, 2001 | (JP) | 2001-302383 |
| Oct. 4, 2001 | (JP) | 2001-308725 |
| Aug. 30, 2002 | (JP) | 2002-252489 |

(51) Int. Cl.
*B66C 23/04* (2006.01)

(52) U.S. Cl. ..... 212/291; 212/231; 212/264

(58) Field of Classification Search ..... 212/291, 212/230, 231, 232, 264
See application file for complete search history.

(56) References Cited

U.S. PATENT DOCUMENTS

| | | | | |
|---|---|---|---|---|
| 3,003,649 | A * | 10/1961 | Przybylski | 212/248 |
| 3,095,945 | A * | 7/1963 | Mitchell | 182/14 |
| 3,300,069 | A * | 1/1967 | Kline | 414/718 |
| 3,509,965 | A * | 5/1970 | Mitchell | 182/62.5 |
| 3,709,322 | A * | 1/1973 | Mitchell | 182/62.5 |
| 4,393,607 | A * | 7/1983 | Hirosawa | 37/443 |

FOREIGN PATENT DOCUMENTS

| | | |
|---|---|---|
| JP | 3-211193 | 9/1991 |
| JP | 6-39316 | 5/1994 |
| JP | 7-137984 | 5/1995 |
| JP | 2529509 | 12/1996 |
| JP | 9-39645 | 2/1997 |
| JP | 10-231087 | 9/1998 |
| JP | 10-236779 | 9/1998 |
| JP | 11-222382 | 8/1999 |
| JP | 2000-16106 | 1/2000 |
| JP | 2000-335885 | 12/2000 |
| JP | 2000-344134 | 12/2000 |
| JP | 2001-140575 | 5/2001 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

In a self-traveling working machine such as a crane, a working attachment such as a boom is arranged to transversely extend below an operator's cabin in such a manner that part of the cabin overlaps the attachment, it being arranged that during crane operation, the cabin is moved widthwise outside the working machine to avoid interference with the boom.

17 Claims, 24 Drawing Sheets

SELF-PROPELLED WORKING MACHINE

BACKGROUND OF THE INVENTION

The present invention relates to a self-traveling working machine such as a rough terrain crane.

DESCRIPTION OF THE RELATED ART

The rough terrain crane (also called a wheeled crane) as one kind of self-traveling working machines is capable of small sharp turns and of moving quickly, and therefore the crane has been used in small scaled construction sites for construction of a private house or the like. Further, a residential district is so narrow in road width that the crane needs to move into a narrow section passing through the roads provided with obstacles such as electric poles, street lamps, trees and the like, and therefore various efforts have been made to reduce the width of the machine.

As a rough terrain crane having a reduced width, the crane disclosed, for example, in Japanese Patent Publication No. Hei 6-39316 is well known. In this crane, a multiple telescopic boom as a working attachment is offset toward one side from the center of the machine body in order to narrow the width of the machine while securing a space for a cabin.

However, the weight of the boom of the rough terrain crane is large with respect to the weight of the machine body, about ⅓, and therefore if such a large-weight boom is offset, the center of gravity of the whole rough terrain crane is deviated from the center of gravity in the width direction of the machine body. Accordingly, the machine body becomes unbalanced to the left and right, and therefore a tilting angle defined in the vehicle control rule in Japan cannot be secured so that the crane cannot run on a general public road.

Further, conventional self-traveling working machines including a self-traveling crane had the following problems.

A. Problem of the Center of Gravity of the Machine Body

In Japanese Patent Laid-Open No. Hei 9-39645 Publication, as an example (see FIGS. 27–29), a position of the center of gravity of the machine body is lowered, and a frame (a traveling frame) of a lower traveling body has high rigidity, thereby enhancing the ability of the crane. That is, in a self-traveling crane having a crane apparatus mounted on a traveling frame 72 of a lower traveling body 71, the traveling frame 72 is box-like whose section is almost closed by two side plates 72c opposed to each other by connecting an upper plate 72a and a bottom plate 72b. Further, front and rear drive shafts (hereinafter referred to as an axle) 74 pass through the traveling frame 72 through through-holes 73 provided in the side plates 72c of the traveling fame 72, and drive shafts 75 for transmitting power to differential gears of the axles 74 also pass through the traveling frame 72. A rotating pedestal portion or a rotating base 76 is disposed in a center portion in the width direction of the traveling frame 72, and an upper rotating body 79 provided with a multistage telescopic rising/falling boom 77 as a working attachment and a cabin 78 is mounted on the rotating pedestal portion 76. An engine 80 is mounted at the rear of the traveling frame 72.

The following effects can be obtained by employing the above-described structure for the traveling frame 72 of the self-traveling crane.

By passing the axle 74 through the traveling frame 72, the position of the traveling frame 72 lowers to lower the height of a roof of the cabin 78, that is, lower the height of the crane in its traveling attitude. Because of this, since the position of the center of gravity of the whole crane lowers, the tilting angle becomes large, and the stability during crane operation is enhanced. Further, the position of the center of gravity of the crane is lowered to thereby provide an allowance in the vertical direction. That is, the height of the traveling frame 72 can be made high, and a sectional area of the traveling frame 72 can be made large, thus enhancing the strength thereof.

However, according to the above-described crane, the rotating pedestal portion 76 for supporting the upper rotating body 79 rotatably is disposed on the upper surface of the traveling frame 72 and is at a position above the support position of the front and rear axles 74, which is therefore insufficient in terms of lowering the height of the machine, and particularly for a smaller width of the machine, it is difficult to secure the traveling stability.

B. Problem of the Length of the Working Attachment

In the self-traveling working machine including a self-traveling crane, the upper rotating body is rotatably mounted on the lower traveling body provided with wheels or crawlers, and the cabin and the working attachment are provided on the rotating frame of the upper rotating body.

In the case of a crane as the working attachment, a multistage telescopic boom is generally supported free to rise and fall on the rotating frame and mounted fore-aft of the rotating frame, passing to one side of the cabin in the maximum fallen state.

Incidentally, the long working attachment is sometimes required in a narrow space depending on the using conditions of the machine, but in mounting the long working attachment to the self-traveling working machine, there results a multistage system in order to permit normal traveling and workability in a narrow space, and the longer the length, the greater the number of stages of the working attachment, to increase the weight thereof.

For solving such a problem as described above, in the mobile crane shown, for example in Japanese Utility Model Registration No 2529509 Publication, the base end of the internal boom is projected rearward from the base end of the external boom in the state that the telescopic boom is most contracted, whereby a pivotal connecting position (raising/lowering position) of the external boom can be moved in the direction of the end of the telescopic boom by a length corresponding to the rearward projecting amount of the internal boom. As a result, the telescoping stroke of the internal boom with respect to the external boom can be increased without increasing the rotating radius of the rear end of the upper rotating body when the crane is working.

Further, in the crane proposed in Japanese Patent Laid-Open No. Hei 3-211193 Publication, the boom is rotatably pivoted at the end of the base boom, the base boom can be rocked laterally with respect to the boom base portion, and even if the long boom is arranged to meet a condition, namely, the radius of rear end of boom at the time of travel>radius of rear end of frame>radius of rear end of boom at the time of working, safety at the time of traveling is secured and the rotating radius of the rear end when the crane is working is made small to enhance workability in a narrow space.

Further, in the anchor executing machine proposed in Japanese Patent Laid-Open No. 2001-140575 Publication, the boom bracket can be moved laterally with respect to the base frame to thereby enhance freedom of execution.

However, in the art shown in the aforementioned Japanese Utility Model Registration No. 2529509 Publication, the internal boom is movably arranged within the external boom so that the internal boom is projected from the rear of the external boom, and therefore the full length of the external boom is unavoidably shortened. Accordingly, the number of stages of the telescopic boom increases and the weight of the telescopic boom increases.

Further, trouble occurs in raising/lowering of the telescopic boom unless the internal boom is moved in an extending direction with respect to the external boom, and therefore a clearance is provided at the lower portion of the telescopic boom, which poses a further problem that a position of the center of gravity of the telescopic boom is high. This may impair the stability of the mobile crane during traveling.

On the other hand, in Japanese Patent Laid-Open No. Hei 3-211193, the base frame and the boom constitute an articulated boom, therefore posing a problem that construction becomes complicated and the weight increases. Further, the height of the rear end portion of the boom is high, a position of the center of gravity of the boom is high, and the stability of the machine body during traveling is possibly impaired.

Further, in the anchor executing machine shown in Japanese Patent Laid-Open No. 2001-140575, the boom bracket itself can be moved laterally, with respect to the mobile crane shown in Japanese Utility Model Registration No 2529509 Publication, and the crane shown in Japanese Patent Laid-Open No. Hei 3-211193, but the boom bracket can be moved only on the upper rotating body, thus posing a problem that when a long boom is mounted, the projecting amount forward of the upper rotating body increases or the number of stages of the boom increases, resulting in an increase of movement into a narrow space or of weight. Further, in the anchor execution machine, since the boom is pivoted at a high position, the center of gravity of the machine body is also high.

With respect to the self-traveling working machine which runs on the road, there are many problems such as a problem of a weight limit of road, and there are disadvantages in terms of travel performance such as acceleration, braking or turning due to an increase in inertia force during traveling resulting from an increase in weight, the traveling apparatus for supporting a great weight is unavoidably large-scaled, resulting in an increase in weight by which the entry into a narrow space is lost. Further, for a higher the center of gravity of the machine body, there are disadvantages in terms of traveling stability with respect to lateral stability.

SUMMARY OF THE INVENTION

Therefore the present invention provides a self-traveling working machine capable of reducing the width of the machine while securing a space for a cabin as much as possible.

The present invention further provides a self-traveling working machine for lowering the center of gravity of the machine body, whereby the traveling stability is secured and sufficient strength and rigidity of a lower frame can be secured.

The present invention further provides a self-traveling working machine capable of reducing the weight of a long working attachment, and of improving an entry property into a narrow space, and workability in a narrow space.

For solving the above-described problems, the present invention provides a self-traveling working machine in which an upper traveling body is mounted on a lower traveling body, and a working attachment free to rise and fall and a cabin are provided on a rotating frame of the upper rotating body, wherein the working attachment is disposed so as to transversely extend at a lower side of the cabin in the maximum lowered state of the working attachment, the cabin is arranged so that at least a part thereof is superposed to the upper surface of the working attachment, and there is provided an interference avoiding means for avoiding interference of the cabin with the working attachment when the working attachment rises and falls.

The present invention further provides a self-traveling working machine in which an upper rotating body is rotatably mounted on a traveling frame of a lower traveling body, wherein the traveling frame is provided with a rotating base for rotatably supporting the upper rotating body in the vicinity of a central portion of the traveling frame, and axle supporting portions provided frontward and rearward, respectively, of the rotating base, the upper surface of the rotating base being positioned downward from the upper surface of the axle supporting portions.

The present invention further provides a self-traveling working machine in which an upper traveling body is mounted on a lower traveling body, a working attachment free to rise and fall and a cabin are provided on a rotating frame of the upper rotating body, and the working attachment extends fore and aft of the rotating frame while passing to a side of the cabin in the maximum lowered state, wherein the rotating frame has a base frame connected to the lower traveling body and a movable frame adapted to move in a backward and forward direction with respect to the base frame, and the movable frame has a fulcrum for raising and lowering the working attachment, the fulcrum being movable rearward from the rear end of the base frame.

DETAILED DESCRIPTION OF THE PREFERRED EMBODIMENTS

In the following embodiments, a wheeled crane (a rough terrain crane), which is one kind of a self-traveling crane is employed, as an example, as a self-traveling working machine to which the present invention is applied.

First Embodiment

See FIGS. 1 to 11

Figure 1:
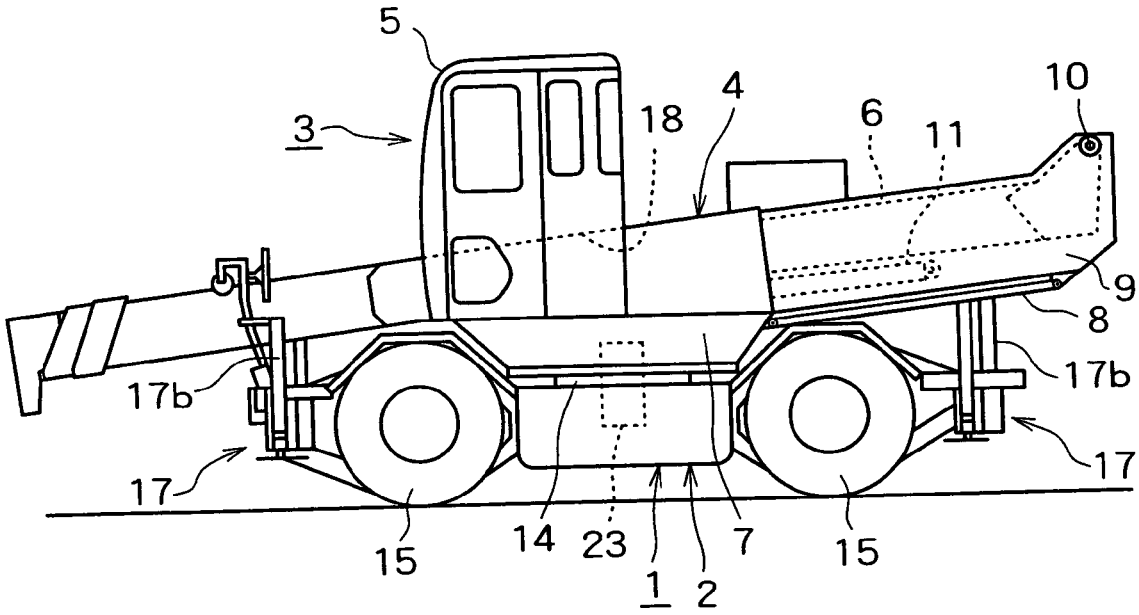
FIG. 1 is a schematic side view of the whole of a self-traveling crane according to a first embodiment of the present invention.
Figure 2:
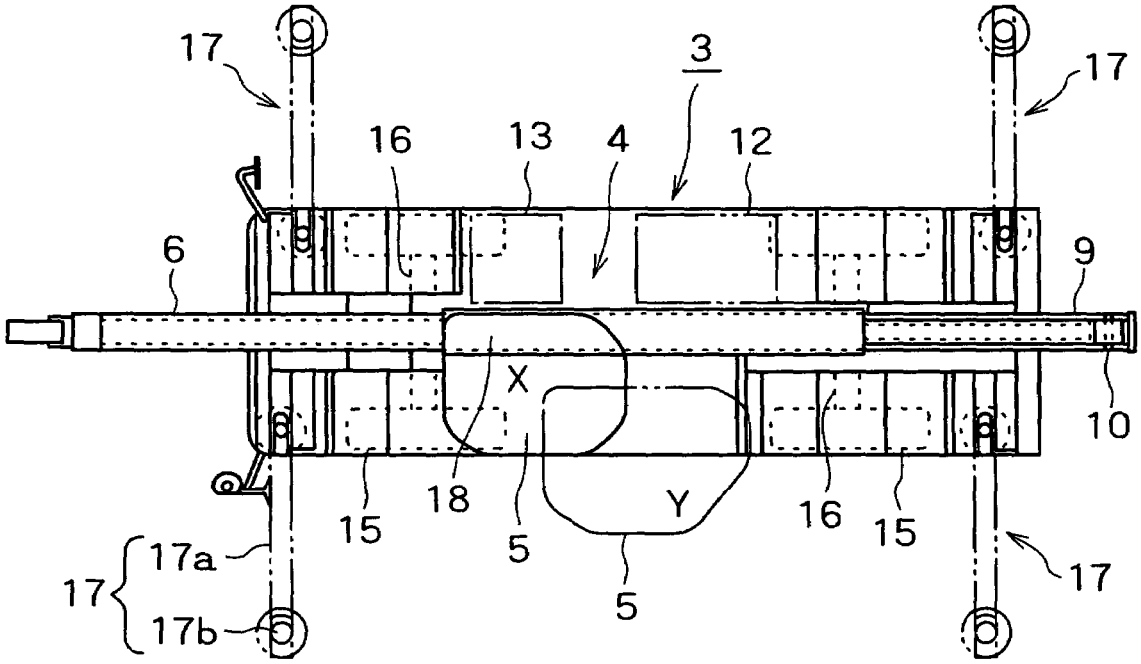
FIG. 2 is a plan view of a first embodiment of the present invention.

FIGS. 1 and 2 show the whole crane according to this embodiment. In these figures, reference numeral 1 denotes a wheel type lower traveling body. A rotating frame 4 of an upper traveling body 3 is mounted rotatably around a vertical axis on a traveling frame 2 of the lower traveling body 1, and an operator's cabin 5 co-used at the time of operation of the crane and at the time of travel, and a multiple or multi-step telescopic boom 6 as working attachment are provided with the rotating frame 4.

The rotating frame 4 comprises a rotatable base frame 7 as a rotating frame main body, and a movable frame 9 supported in a forwardly inclined state such that a front end portion thereof is lower than a rear end portion and moved in a backward and forward direction by a frame moving cylinder 8, and a boom 6 is supported to be free to rise and fall on the rear end portion of the movable boom 9 through a boom foot pin 10. Reference numeral 11 denotes a boom raising/lowering cylinder.

Meanwhile, hydraulic devices, a hydraulic pump for supplying pressure oil to the hydraulic devices, an engine 12 as a drive source for the pump or the like, and a working oil tank 13 are disposed on the rotating frame 4.

The rotating frame 4 is rotatably mounted through a rotating bearing 14 in an approximately center portion in a fore-aft (machine length) direction of the traveling frame 2 and in a width (machine width) direction. Axles 16 having tires 15 mounted at their ends are provided on both front and rear sides of the traveling frame 2.

Further, on both front and rear end portions of the traveling frame 2, there is provided an outrigger device 17 provided with an outrigger beam 17*a* extended outward in the width direction during crane operation, and an outrigger cylinder 17*b* extended downward in the state that the outrigger is extended to raise the crane. Meanwhile, when the crane is traveling, the outrigger cylinder 17*b* is contracted, and the outrigger beam 17*a* is contracted and stored inside the crane body.

The base frame 7 of the rotating frame 4 is arranged at an approximately central portion in the width direction (the width direction of the whole crane) of the lower traveling body 1, and the movable frame 9 is supported on the base frame 7.

Accordingly, the boom 6 is positioned at an approximately center portion in the width direction in its maximum fallen state when the crane is traveling. Further, the boom 6 is constructed so that the extreme end thereof is a front end of the whole crane, and the rear end is a rear end of the whole crane.

Further, as shown in FIG. 2, the cabin 5 is disposed at one side of the boom 6 on the rotating frame 4, i.e., on the left side with respect to the crane advancing direction, and at the other side are the engine 12 and the working oil tank 13. By the above arrangement, the center of gravity of the machine body is positioned at a central position widthwise.

A recess portion 18 of the cabin 5 for an upper end of the boom 6 is formed at a lower position of the cabin 5 on the central side of the machine body, and when the cabin 5 is at a position X within the width of the machine body as a width internal position shown by the solid line in FIG. 2, a part of the upper surface of the maximum fallen boom 6 faces the recess portion 18. That is, a part of the cabin 5 positioned at the boom side overlaps a part of the boom 6 positioned at the cabin side. In this manner, the recess portion 18 is formed at the lower position of the cabin 5 whereby a sufficiently large space can be secured within the cabin 5, and particularly the upper internal space where an operator tends to feel confined can be widened.

Here, when the cabin 5 is superposed on a part of the upper surface of the boom 6 as described above, the boom 6 cannot be raised to carry out working of the crane. So cabin moving means as interference avoiding means for avoiding interference between the boom 6 and the cabin 5 at the time of work is provided, by which means the cabin 5 can be moved from the width internal position X to a left obliquely rear side projecting position Y as a side projecting position without interfering with the raising/lowering operation of the boom 6.

Figure 3:
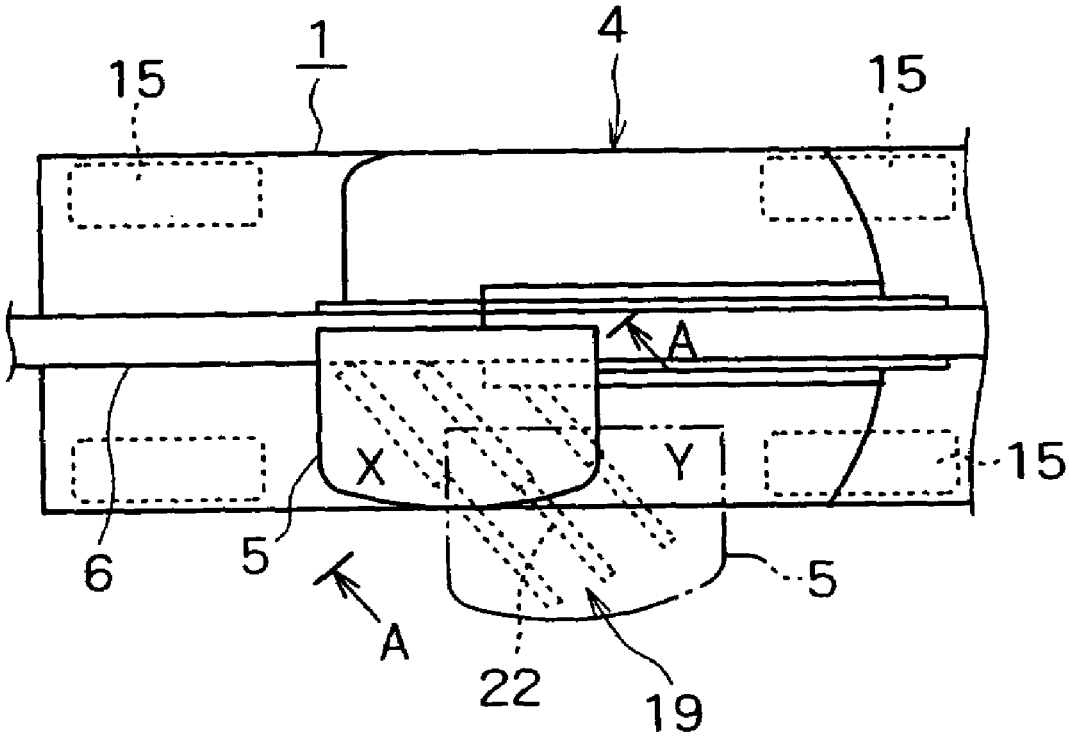
FIG. 3 is a plan view of a cabin and a peripheral portion thereof in the crane.
Figure 4:
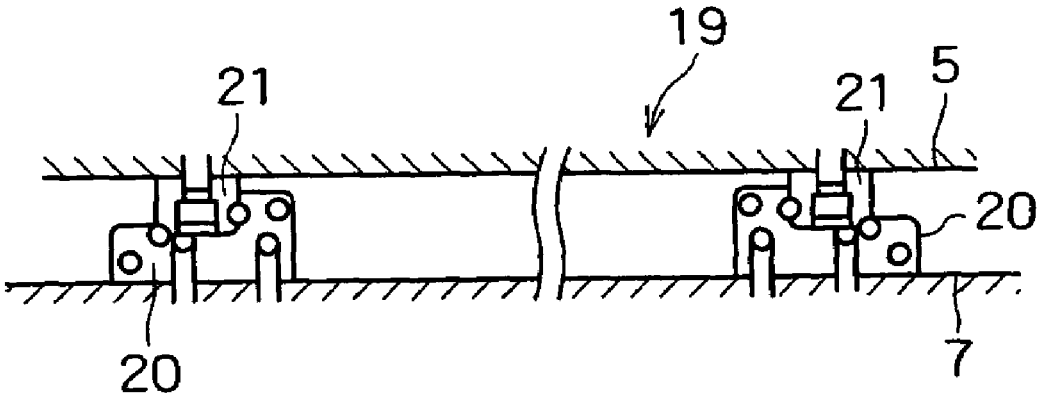
FIG. 4 is a sectional view taken on line A—A of FIG. 3.
Figure 5:
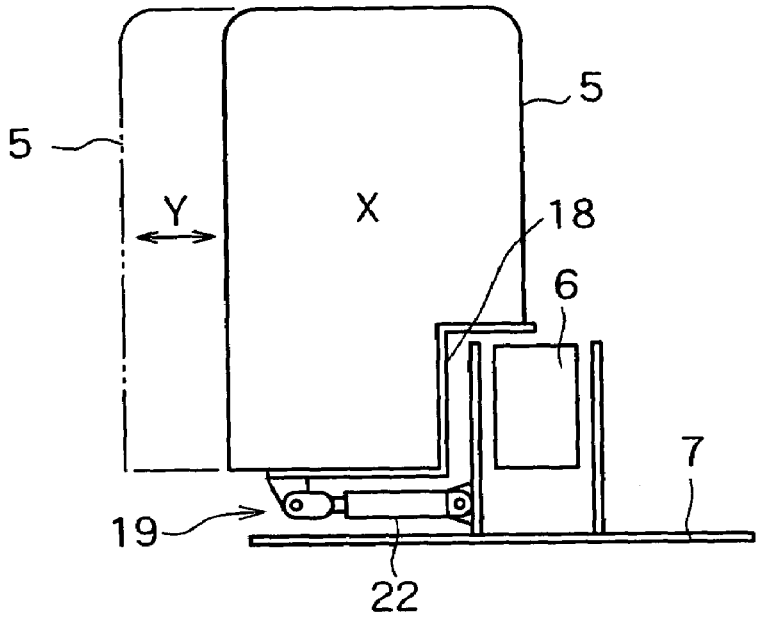
FIG. 5 is a back view of a cabin and a peripheral portion thereof.

This point will be described in detail with reference to FIGS. 3 to 5. The cabin moving means 19 comprises a pair of rail-like guides 20 disposed in parallel with the base frame 7 of the rotating frame 4, rail-like sliders 21 disposed on the bottom surface of the cabin 5, engaged with the rail-like guides 20 so as to enable sliding, and a cabin moving cylinder 22 is provided between the base frame 7 and the bottom surface of the cabin 5 between both the rail-like guides 20.

Note that the cabin 5 is moved to the left oblique rear side projecting position Y to secure a moving amount perpendicular to a center line in the width direction of the lower traveling body 1 necessary to avoid the boom 6, thereby accessing a straight line passing through a rotating center point of the upper rotating body 3, to prevent projecting the cabin 5 outside the maximum rear end rotating radius of the crane.

Incidentally, if the boom 6 is raised due to erroneous operation when the cabin 6 is at the width internal position X, the cabin 5 may be possibly damaged. So a controller (not shown) to control actuators so that the boom 6 cannot be raised when the cabin 5 is at the width internal position X processes signals from sensors. In the following, the method for controlling the boom will be described with reference to FIGS. 6 to 8.

Figure 6:
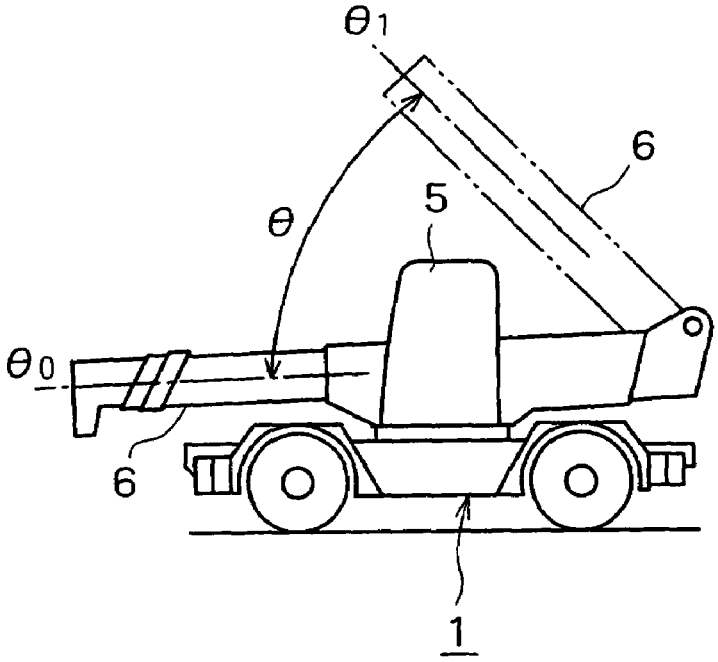
FIG. 6 is a schematic side view for explaining a boom rising/falling limiting operation in the crane.
Figure 7:
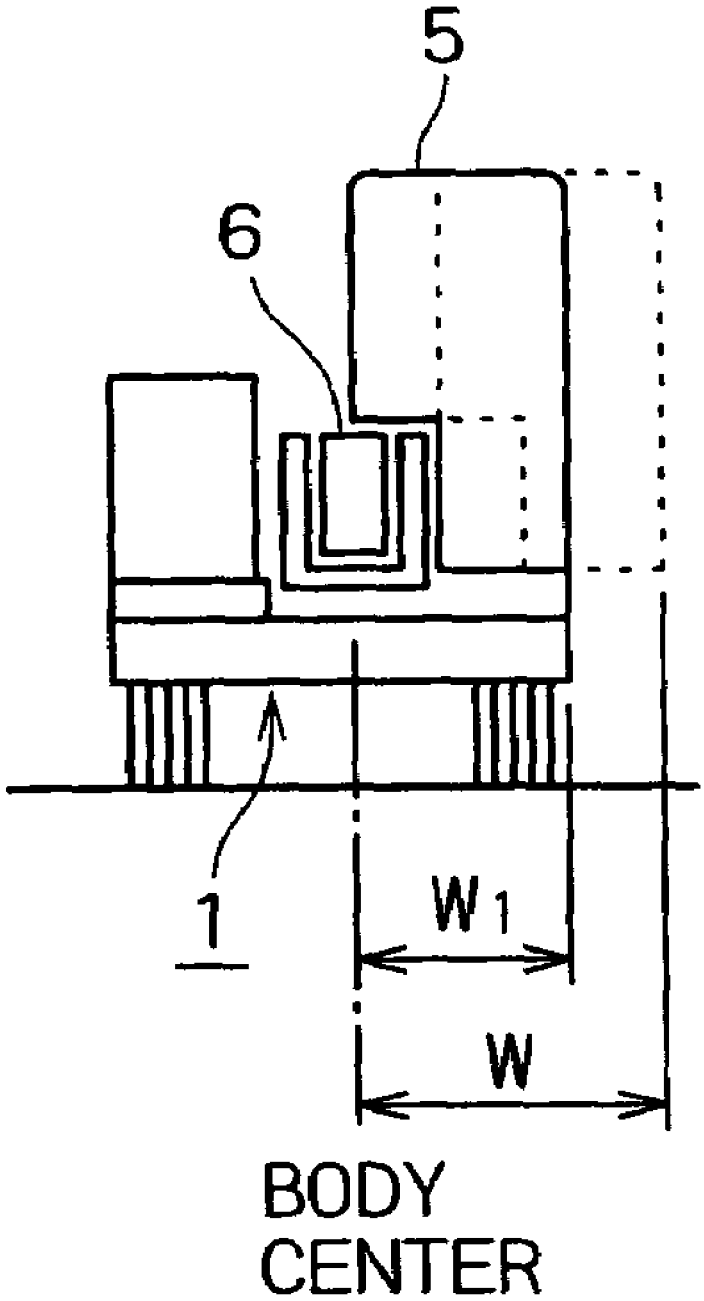
FIG. 7 is a front view of the same.
Figure 8:
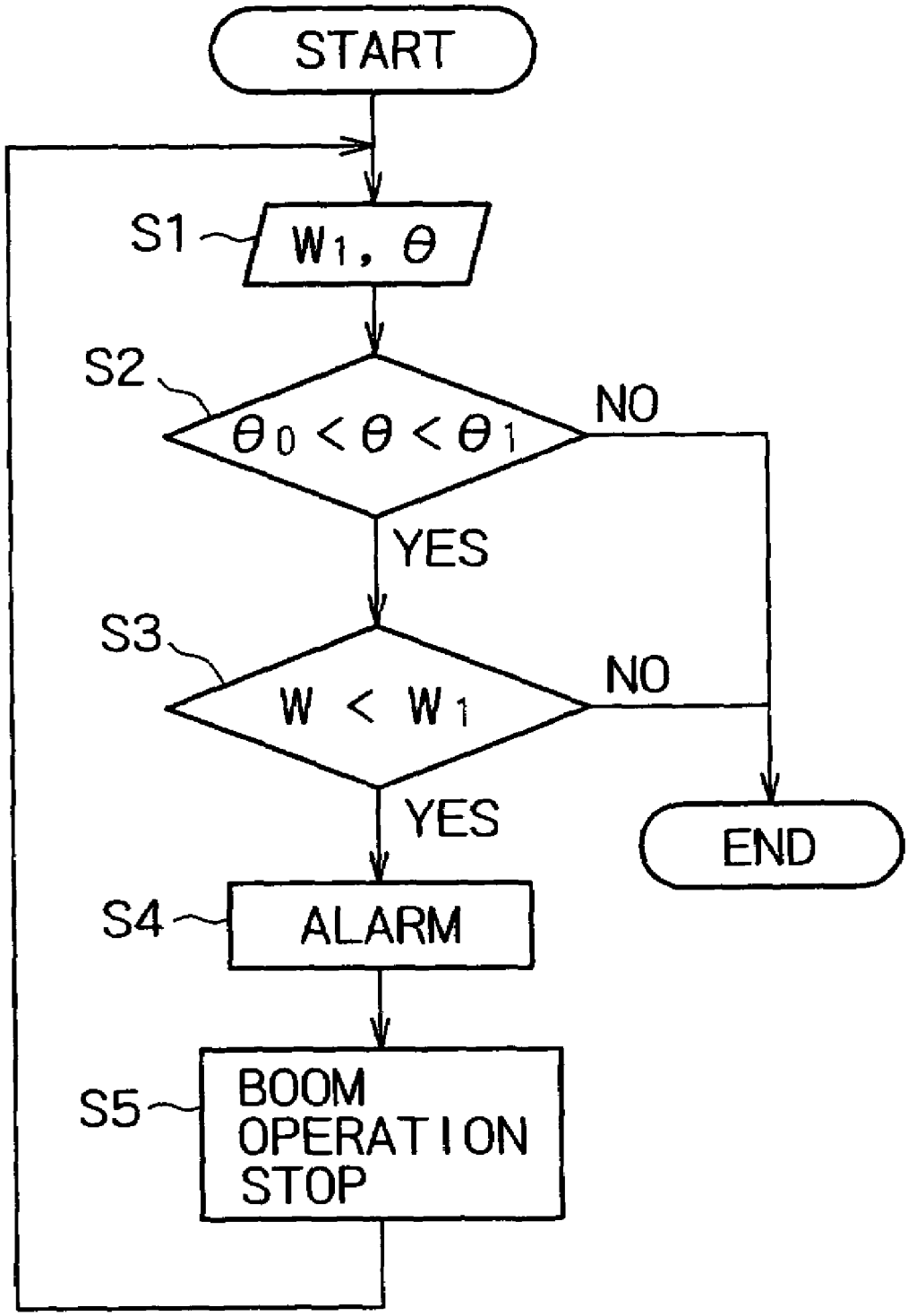
FIG. 8 is a flow chart of the same.

As shown in FIG. 6, let $\theta_0$ be the maximum fallen angle of the boom 6, $\theta_1$ be the maximum risen angle, and $\theta$ be the detected elevated angle of the boom 6 between the maximum fallen angle $\theta_0$ and the maximum elevated angle $\theta_1$. Further, as shown in FIG. 7, let $W_1$ be the detected distance from the width center of the lower traveling body 1 to the outer surface of the cabin 5, and W be the distance from the width center at the side projecting position Y to the outer surface of the cabin, then the rising/falling of the boom 6 is controlled in accordance with the flow shown in FIG. 8.

First, detecting of a rising/falling angle of the boom 6 by a boom angle sensor (not shown), and detecting and reading of the distance $W_1$ by a cabin position sensor (not shown) provided on the cabin moving cylinder 22 are carried out (Step S1). Next, in Step S2, whether $\theta$ is between $\theta_0$ and $\theta_1$ or not is judged. In case of "No" where $\theta$ is not between $\theta_0$ and $\theta_1$, the boom 6 is in the maximum fallen state, thus terminating controlling. On the other hand, in case of "Yes" where $\theta$ is between $\theta_0$ and $\theta_1$, the control proceeds to Step S3, and W is compared with $W_1$. In case of "No" where $W_1$ is larger than W, there is no possible interference of the boom 6 with the cabin 5, thus terminating controlling. On the other hand, in case of "Yes" where $W_1$ is smaller than W, the boom 6 interferes with the cabin 5, thus starting an alarm (Step S4), and, at the same time, the boom rising/falling cylinder 11 is locked to automatically stop the rising/falling operation of the boom 6.

Incidentally, in either of the case where $\theta$ is between $\theta_0$ and $\theta_1$ (in Step S2, Yes) or the case where $W_1$ is smaller than W (in Step S3, Yes), if an operating lever is locked, an effect equal to that of the above-described control can be obtained.

When both $\theta$ and W are used as described above, even if either an angle detection sensor for detecting a boom rising/falling angle, for example, or a cabin position detection sensor for detecting a position of the cabin 5 is down or out of order, it is possible to prevent the boom 6 from interfering with the cabin 5. Therefore, the safety and reliance of the crane can be further improved.

Further, when traveling public roads in a state that the cabin 5 is at the side projecting position Y, the cabin 5 possibly interferes with a public construction, for example, such as an electric pole. On the other hand, in a work site, it is necessary to freely raise or lower the boom 6, and the machine has to travel in a state that the cabin 5 is at a side projecting position Y as the case may be.

So, when the cabin 5 is at the side projecting position Y, whether the cabin 5 is positioned within the machine width is judged by a vehicle speed sensor and the cabin position detection sensor (not shown) so that the maximum speed is limited to be below the fixed speed (for example, 10 Km/h).

Note that pressure oil discharged from the hydraulic pump driven by the engine 12 shown in FIG. 2 is supplied to all of the hydraulic devices for operation disposed within the cabin 5, a beam operating cylinder (not shown) for extending and storing an outrigger beam 17*a* through a swivel joint 23 provided in the center of a rotating bearing 14, an outrigger cylinder 17*b*, a hydraulic traveling motor (not shown) for driving an axle 16 of the lower traveling body 1, and a steering device. Further, brake oil is also supplied to a brake caliper through the swivel joint 23.

Further, pressure oil discharged from the pump is supplied, without intervention of the swivel joint 23, to the frame moving cylinder 8 for moving the movable frame 9 of the rotating frame 4, the boom rising/falling cylinder 11, a boom telescoping cylinder (not shown) for telescoping the boom 6, and a winding up hydraulic motor of a winch (not shown) for winding up and down a wire rope.

According to this crane, the heavy boom 6 passes downward to the recess portion 18 of the cabin 5, close to the center of the machine width in the maximum fallen state, and therefore the center of gravity of the machine body can be lowered to a further lower position at a position close to the center of the machine width. Therefore, the width of the whole crane can be contracted while securing a tilting angle of the crane.

Moreover, the cabin 5 moves, when the boom is raised/lowered, from the width internal position X to the left obliquely rear side projecting position Y, and therefore interference between the cabin 5 and the boom 6 when the crane is operated can be avoided.

Further, at the side projecting position Y, the operating state of the crane can be viewed from the side of the lower traveling body 1 and the forward field of view can be enlarged, thus enhancing the workability of the crane.

Further, when the cabin 5 is at the width internal position X, the raising/lowering operation of the boom 6 is checked, and when the cabin 5 is at the side projecting position Y, the speed is limited, and therefore it is possible to prevent the boom 6 from erroneously impinging upon the cabin 5 to damage it, and safety at the time of travel can be secured.

In addition, according to this crane, the boom 6 is mounted on the rear end of the movable frame 9 which moves in a backward and forward direction, through the boom foot pin 10, and in the maximum fallen state of the boom 6 (the crane's traveling state), the extreme end of the boom 6 is at the front end of the crane and the rear end thereof is at the rear end of the crane. Therefore, the boom foot pin 10 (fulcrum as raising/lowering point) of the boom 6 is moved whereby the work efficiency of feeding a hanging article for moving a hanging article in a horizontal direction is enhanced. Further, the boom 6 can be made longer, or when the length of the boom 6 is made the same, the projecting amount (overhanging amount) of the boom 6 forward of the lower traveling body can be shortened to enhance the forward view of field at the time of travel, and to improve moving into a narrow property.

Figure 9:
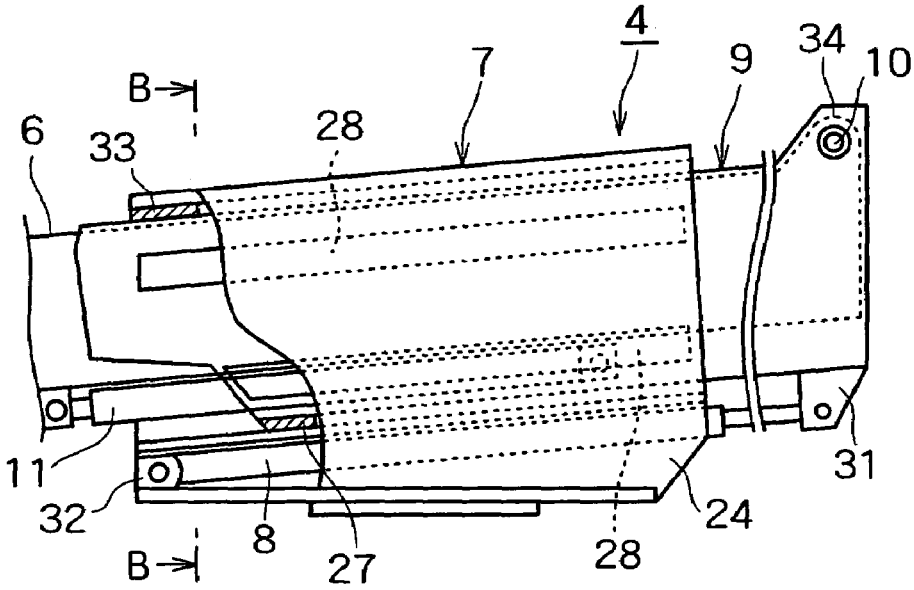
FIG. 9 is a partial side view of a rotating frame and boom in the crane.
Figure 10:
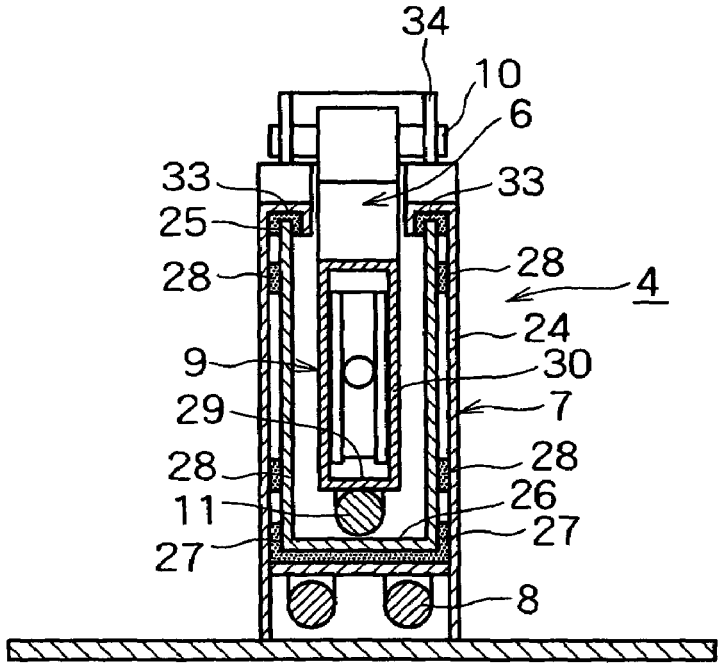
FIG. 10 is a sectional view taken on line B—B of FIG. 9.

Next, the construction of the base frame 7 of the rotating frame 4, the movable frame 9, and the boom 6 will be described with reference to FIGS. 9–11. The base frame 7 of the rotating frame 4 has a pair of left and right bracket plates 24. The bracket plates 24 have rear portions with a high front-down slope, and a guide groove 25 is formed in a fore-aft direction internally of the upper portion thereof. Further, a bottom plate 26 is provided at the same slope as that mentioned above and has approximately the same slope on the lower portion between both the bracket plates 24.

Pads 27, 28 are provided on the upper surface and side, respectively, of the bottom plate 26, so as to slidably guide the movable frame 9. The movable frame 9 forms an elongated groove shape composed of the bottom plate 29 and a side plate 30, in which a bottom plate 29 is slidably placed on the pad 27, and the frame moving cylinder 8 is mounted between a bracket 31 provided on the rear ventral surface and a bracket 32 provided on the base frame 7 between the bracket plates 24.

Further, a pad 33 is mounted on the upper portion of the side plate 30 to engage the guide groove 25 of the bracket plate 24 so as to be sidably guided. A projecting portion 34 extends upward at the rear of the side plate 30, and the boom 6 is free to rise and fall on the projecting portion 34 through the boom foot pin 10. The pads 27, 28 and 33 may be provided over the full length of the base frame 7 or may be provided only where necessary such as front and rear ends. Further, the pad 28 may be mounted through a pad carrier (a pad mounting member) as necessary, and moving in/out of the side thereof may be adjusted by shims.

In the base frame 7 of the rotating frame 4 constructed as described above, the movable frame 9 having at the rear thereof the boom foot pin 10 to be a fulcrum for raising/lowering of the boom 6, is provided movably in a fore-aft direction by the frame moving cylinder 8, and therefore at the time of travel, the frame moving cylinder 8 is actuated so that movable frame 9 may assume a position at the rear of the base frame 7. Thereby, the projecting amount of the boom 6 forward of the rotating frame can be suppressed, and therefore the long boom 6 can be made longer and reduced in weight, and lowered in the center of gravity as compared to one having four stages.

Further, the movable frame 9 may be moved as necessary at the time of work to set the fulcrum for raising/lowering to a suitable position. Furthermore, the backward moving distance of the movable frame 9 with respect to the base frame 7 is set longer, thus enabling coping with various kinds of operations in a flexible manner.

Further, the movable frame 9 is made longer as required not to give trouble to rotation at the time of work, and projecting it longer from the extreme end of the base frame 7 at the time of storage into the base frame 7, whereby the boom 6 can be lengthened.

Further, the movable frame 9 is moved at the same inclining angle as the front-down inclining angle in the maximum fallen state of the boom 6 with respect to the base frame 7. In doing so, the space required for movement of the movable frame 9 can be lessened as compared with the case of moving in a horizontal direction. Thereby, there occurs no problem in interference between the movable frame 9 and various parts of the crane, freedom of layout of devices to be equipped increases, and the whole crane can be made more compact.

Further, when the movable frame 9 moves, there is no interference between the lower traveling body 3 and the boom 6, and the boom 6 can be placed closer to the upper surface of the lower traveling body 1 in the attitude at the time of travel.

Thereby, the center of gravity of the machine at the time of travel can be lowered considerably, and the left and right tilting angle of the crane can be made large, thus enabling a narrowing of the width of the machine.

Further, the boom 6 is disposed so as to pass approximately at the center in the width direction of the lower traveling body 1 to thereby enabling it to make longer.

On the other hand, where the rotating center of the rotating frame 4 is the center of the lower traveling body 1, in the state that the boom 6 is projected forward and backward of the lower traveling body 1, and if the projecting length forward and backward of the boom 6 is made approximately the same, its minimum right-angle width can be made to the smallest state.

Figure 11:
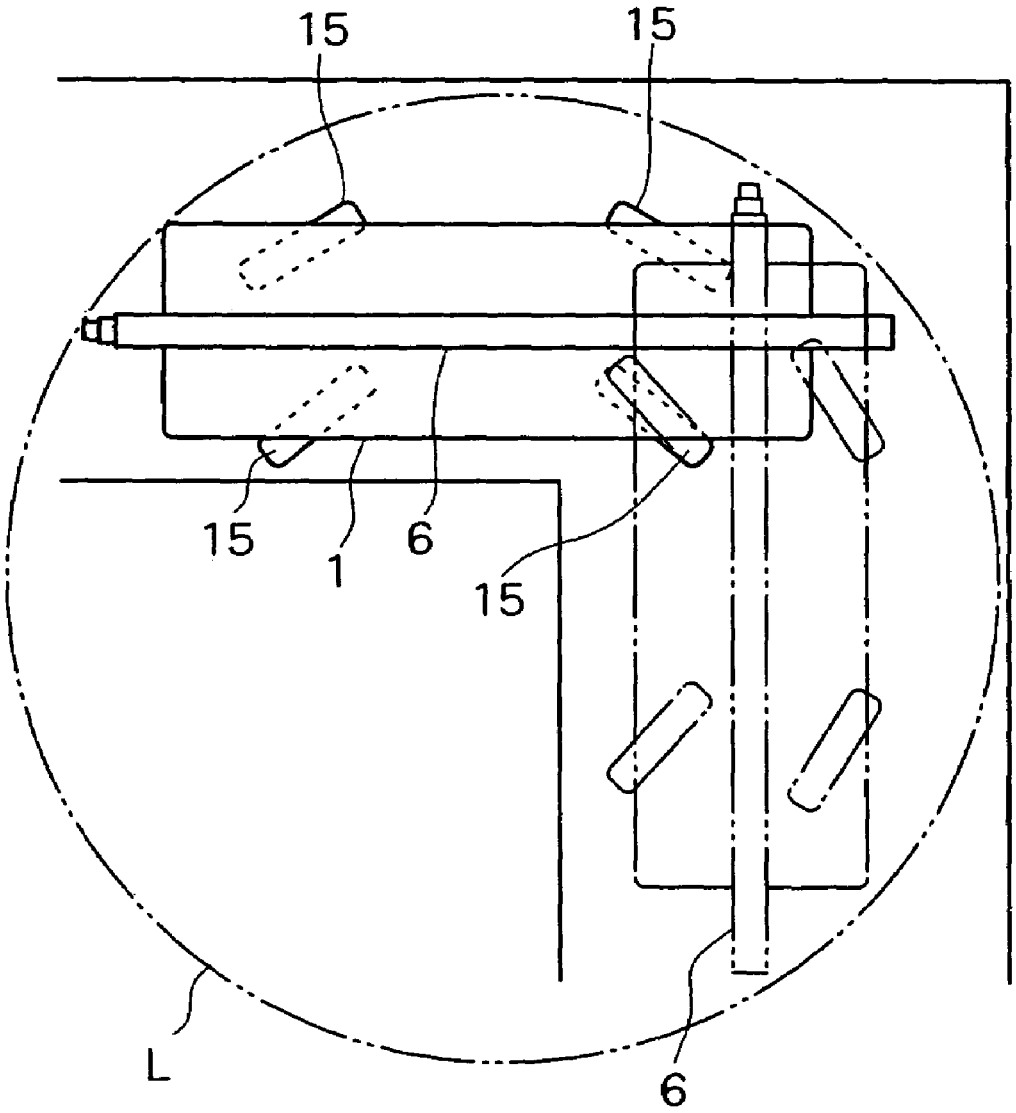
FIG. 11 is an explanatory view of entry into a right-angle road of the crane.

Further, as shown in FIG. 11, preferably, the minimum right-angle traveling locus L formed by the front end and rear end of the boom 6 may be approximately the same as that formed by the lower traveling body 1. In doing so, the right-angle moving performance at the time of travel is not impaired while making the boom 6 longest. Note that if the locus of the front end and rear end of the boom 6 at the time of minimum rotating travel as described above is made internally from the outer end of the lower traveling body 1, damage caused by the interference between the boom 6 at the time of travel and an obstacle can be prevented.

Further, the hydraulic devices, the engine 12 for driving the hydraulic pump for supplying pressure oil to the hydraulic devices, and the working oil tank 13 are disposed on the base frame 7, and the boom foot pin 10 as the fulcrum for raising/lowering the movable frame 9 can be projected backward from the rear end of the lower traveling body 1. Therefore, a portion near the center of gravity of the lengthy boom 6 can enhance traveling stability. Further, with respect to the projecting amount from the machine body, there is a limitation in laws and regulations, and therefore it is projected while adjusting it before and behind, whereby the boom 6 can be made longest.

The mounting position of the boom foot pin 10 to be the fulcrum on raising/lowering of the movable frame 9 is positioned to be lower than an approximately central position in the height direction of the cabin 5, whereby the heavy boom 6 is positioned downward to lower the center of gravity of the whole crane, and the side field of view and the backward field of view can be improved.

Modification of First Embodiment (1) In the first embodiment, the cabin 5 is moved in the direction away from the boom 6 by the cabin moving means 19. However the cabin 5 may be mounted on the boom 6 so as to be free to rock through the support shaft, a cylinder may be provided between the cabin 5 and the boom 6, and the cabin 5 may be held horizontally irrespective of the raising/lowering angle of the boom 6.

(2) In the above-described embodiment, the cabin moving means 19 is provided as interference avoiding means. However, it is possible to instead use a pair of left and right attachment support frames obliquely inclined internally of the machine body from the lower portion of the cabin 5.

The boom foot pin inclined in the width direction is provided on the attachment support frames, and the boom 6 is raised and lowered along the inclined inner surface of the attachment support frames. In doing so, the boom 6 is stored in approximately the center of the width in the maximum lowered state, and is elevated in the obliquely upward direction away from the cabin 5 as in an elevation operation.

According to this structure, the interference between the boom 6 and the cabin 5 can be avoided without using the cabin moving cylinder 22 as in the cabin moving means 19 or using the frame moving means for moving the attachment support frames.

Further, as another interference avoiding means, the movable frame 9 may be disposed on a laterally moving bed capable of approching/moving away from the cabin 5, whereas a pair of rail-like guides are provided in parallel with the base frame 7, and a rail-like slider which engages the rail-like guide and slides is provided on the bottom surface of the laterally moving bed respectively, and the laterally moving bed (movable frame 9) is moved by the hydraulic cylinder provided between the base frame 7 and the laterally moving bed.

Further, as the drive means for moving the cabin 5, in place of the cabin moving cylinder 22, for example, a rack may be provided on the rail-like guides 20, and a pinion fitted in the extreme end of an output shaft of a reversible motor provided in the cabin 5 may be meshed with the rack.

Note that in the above-described embodiment, the boom 6 is disposed approximately in the center position in the width direction, but preferably the center of the boom 6 with respect to the center of the machine is an offset by an amount within about 4% of the width dimension.

(3) In the first embodiment, the position of the boom foot pin 10 is at approximately a central position in the height direction of the cabin 5, but if the position of the boom foot pin 10 is arranged to be further lower, the center of gravity of the crane can be further lowered.

(4) In the above-described example, hydraulic devices, the engine 12 for driving the hydraulic pump for supplying pressure oil to the hydraulic devices, and the working oil tank 13 are disposed on the base frame 7, and the boom foot pin 10 to be the fulcrum for raising/lowering of the boom 6 can be projected backward from the rear end of the lower traveling body 1. However, in place of the above-mentioned structure the engine 12 and the like may be mounted on the side of the lower traveling body 1 similar to prior art, and the boom foot pin 10 is not projected backward from the rear end of the lower traveling body 1. In this case, the lower traveling body 1 itself is possibly large-scaled similar to the prior art, but even so the boom foot pin 10 can be positioned backward of the base frame 7, the boom 6 is not projected from the rear end of the lower traveling body 1 at the time of travel, and the forward projecting amount of the rotating frame can be suppressed.

(5) In the above-described example, the boom 6 is mounted to slant down from back to front in the maximum fallen state, but it may instead be mounted horizontally in which the case, even if the fulcrum for raising/lowering of the boom 6 is moved from forward position to backward position, as compared with the case of mounting to slant down, the height of the boom at the cabin side position is not lowered, and the enhancement of the field of view from side to obliquely forward is not desired, but the forward field of view can be enhanced considerably, and other aforementioned operations and effects can be likewise given.

Second Embodiment

See FIGS. 12 to 17

Only the difference from the first embodiment will be described.

The frame moving cylinder 8 is disposed externally of the base frame 7 in the rotating frame 4, and the rod end of the cylinder 8 is connected to the extreme end of a cylinder connecting pin 36.

Figure 13:
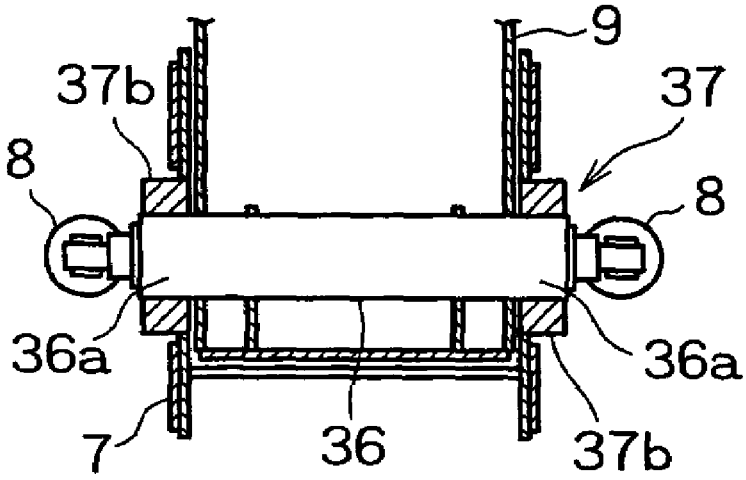
FIG. 13 is a sectional view taken on line C—C of FIG. 12.

The cylinder connecting pin 36 passes through the base frame 7 at the rear end of the movable frame 9 and at the lower position of the boom 6 (see FIG. 13).

A projecting portion from the base frame 7 of the cylinder connecting pin 36, more specifically a portion between the side of the base frame 7 and the connecting portion of the rod of the frame moving cylinder 8, forms a an engaging portion 36*a* in engagement with a stop portion described later.

Figure 12:
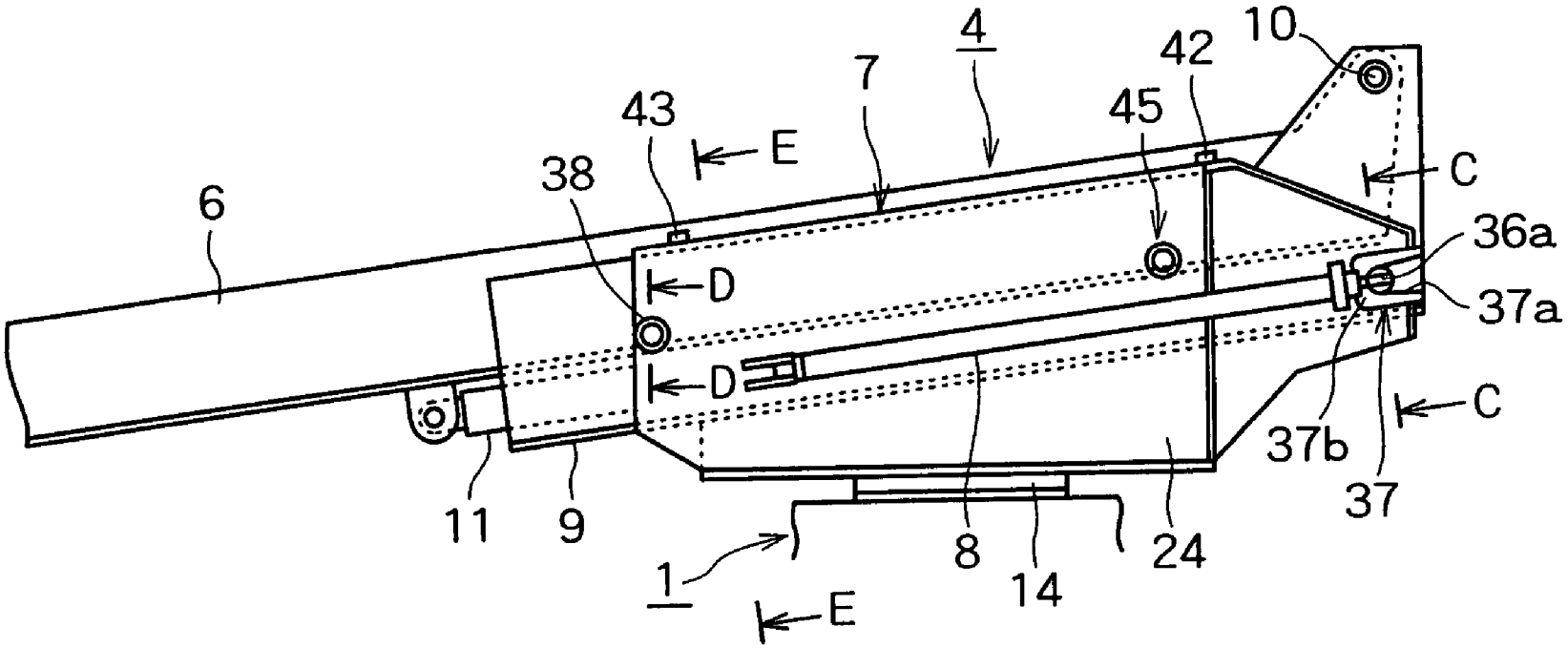
FIG. 12 is a partial side view of a rotating frame and boom in a self-traveling crane according to a second embodiment of the present invention.

Further, as shown in FIG. 12, the rear ends of both bracket plates 24 of the base frame 7 are formed into an approximately lateral trapezoidal shape whose vertical dimension reduces toward the rear end, and the extreme end thereof is formed with a stop portion 37 that stops at the engaging portion 36*a* when the movable frame 9 is most contracted. The stop portion 37 comprises a notch 37*a* whose depth portion is semicircular, and an approximately U-shaped block 37*b* having a notch (not shown) of the same shape as the notch 37*a* internally thereof, and being welded to the side of the base frame 7 so that these notches coincide with each other.

Note that the rear end portion of the base frame 7 may be flat. Further, the notch 37*a* of the stop portion 37 is formed such that the width of an opening is wide and becomes narrow toward the interior, the depth being circular, which structure is provided to secure the most contracted movable frame 9 to the base frame 7 without rattle, and therefore it is not limited to the aforementioned shape but may be formed to be a rectangular shape provided with upper and lower parallel sliding surfaces.

Figure 14:
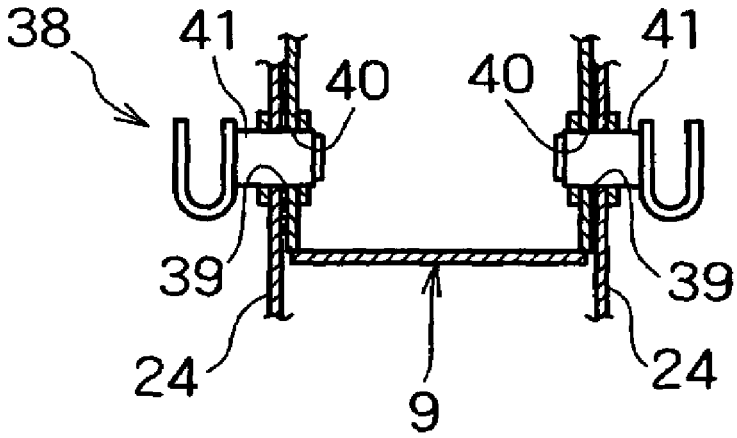
FIG. 14 is a sectional view taken on line D—D of FIG. 12.

Further, securing means 38 at the time of contraction for securing the most contracted movable frame 9 to the base frame 7 is provided in the vicinity of the front end of both bracket plates 24 (only one side is shown in FIG. 1) of the base frame 7 and above the frame moving cylinder 9. The securing means 38 comprises, as shown in FIG. 14, an external pin hole 39 provided in the bracket plate 24 of the base frame 7, an internal pin hole 40 provided in the side plate of the movable frame 9, and a fixing pin 41 inserted over the pin holes 39, 40.

Figure 16:
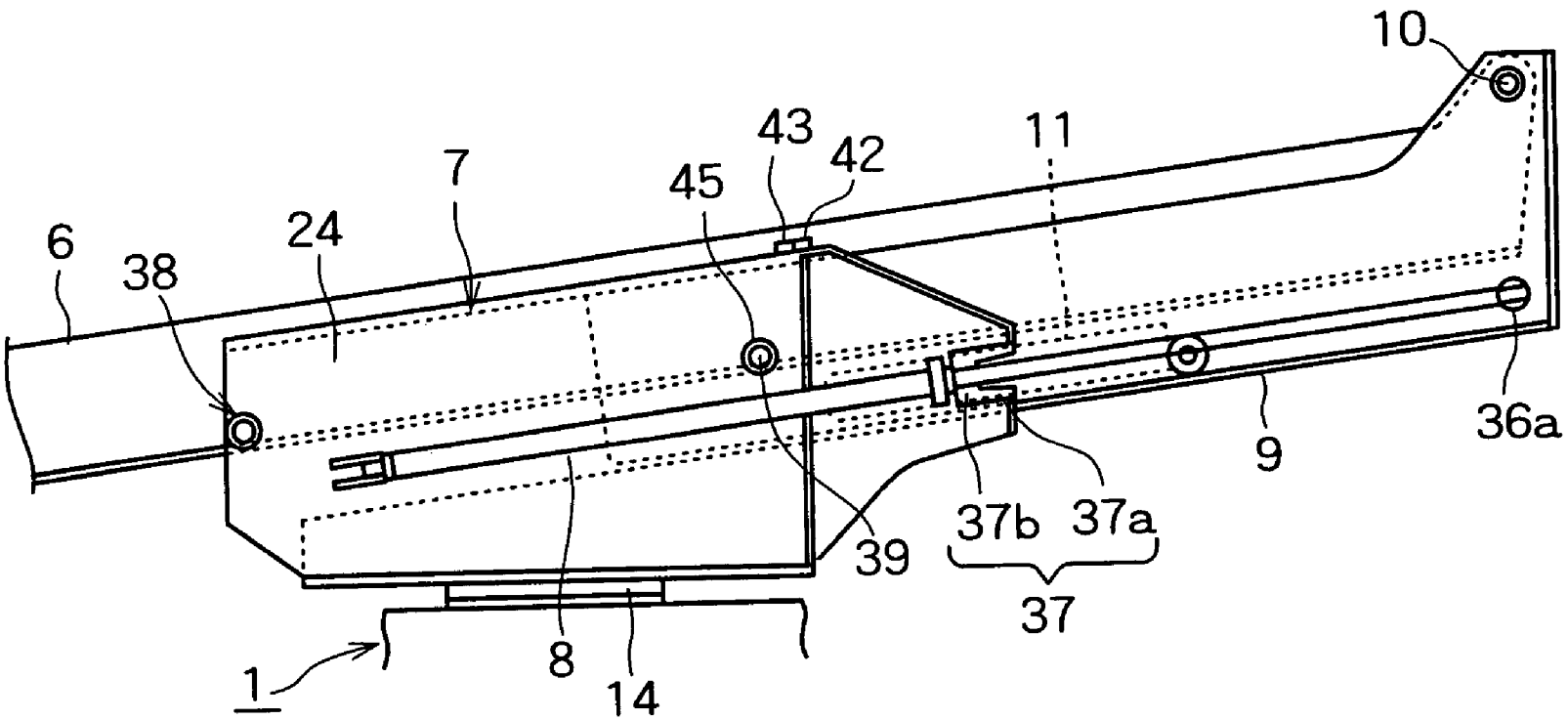
FIG. 16 is a side view of a state that a movable frame is contracted from the FIG. 12 state.

Note that stoppers 42, 43 (see FIGS. 12, 16) are provided on the rear upper end of the base frame 7 and the side of the boom 6, respectively, and these stoppers 42, 43 come into contact when the movable frame 9 in the boom fallen state shown in FIG. 16 is most extended (when moved backward) to thereby positional control the extended state of the movable frame 9.

Figure 15:
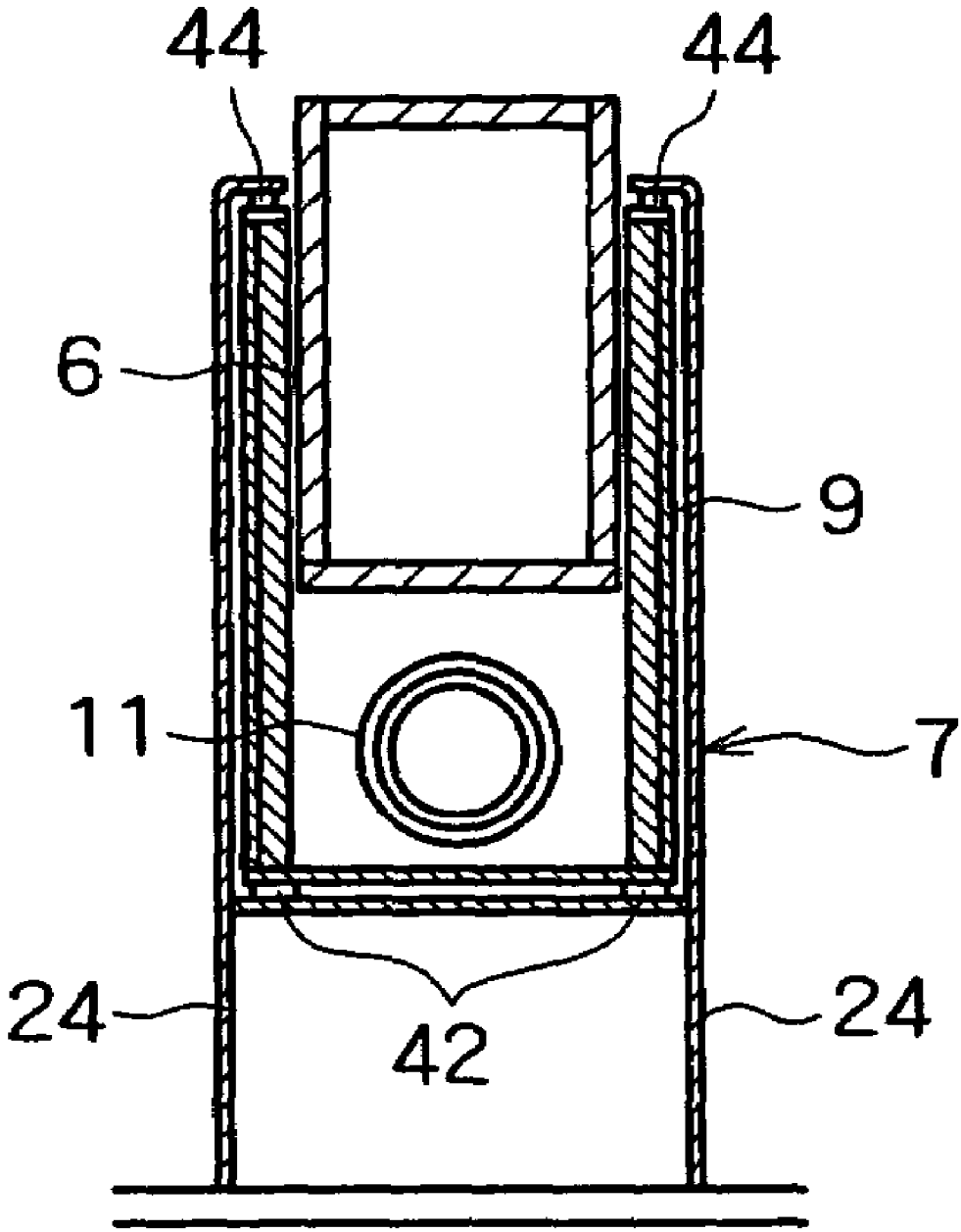
FIG. 15 is a sectional view taken on line E—E of FIG. 12.

A sectional shape of the base frame 7 is that as shown in FIG. 15, the upper ends of the left and right bracket plates 24 are bent in the direction opposed to each other, a sliding pad 44 provided with a flat sliding surface is mounted on the lower surface of the bent portion and the upper surface of the bottom plate provided on the lower portion between the left and right bracket plates, and the movable frame 9 is incorporated slidably therebetween.

Further, as shown in FIG. 16, securing means 45 at the time of extension for securing the most extended movable frame 9 to the base frame 7 is provided on the side at the rear of the bracket plates 24 of the base frame 7 and above the frame moving cylinder 8 in the vicinity of the base end of the lateral trapezoidal forming portion. The securing means 45 comprises, similar to the securing means 38, an external pin hole provided in the bracket plate surface of the base frame 7, an internal pin hole provided in the side plate of the movable frame 9, and a fixing pin common to these pin holes (these are not shown), which are used in common to fixing pins 41 shown in FIG. 14.

Note that the distance between the centers of the securing means 38 at the time contraction and the securing means 45 at the time extension is set to the same dimension as that of the stroke of the movable frame 9.

Figure 17:
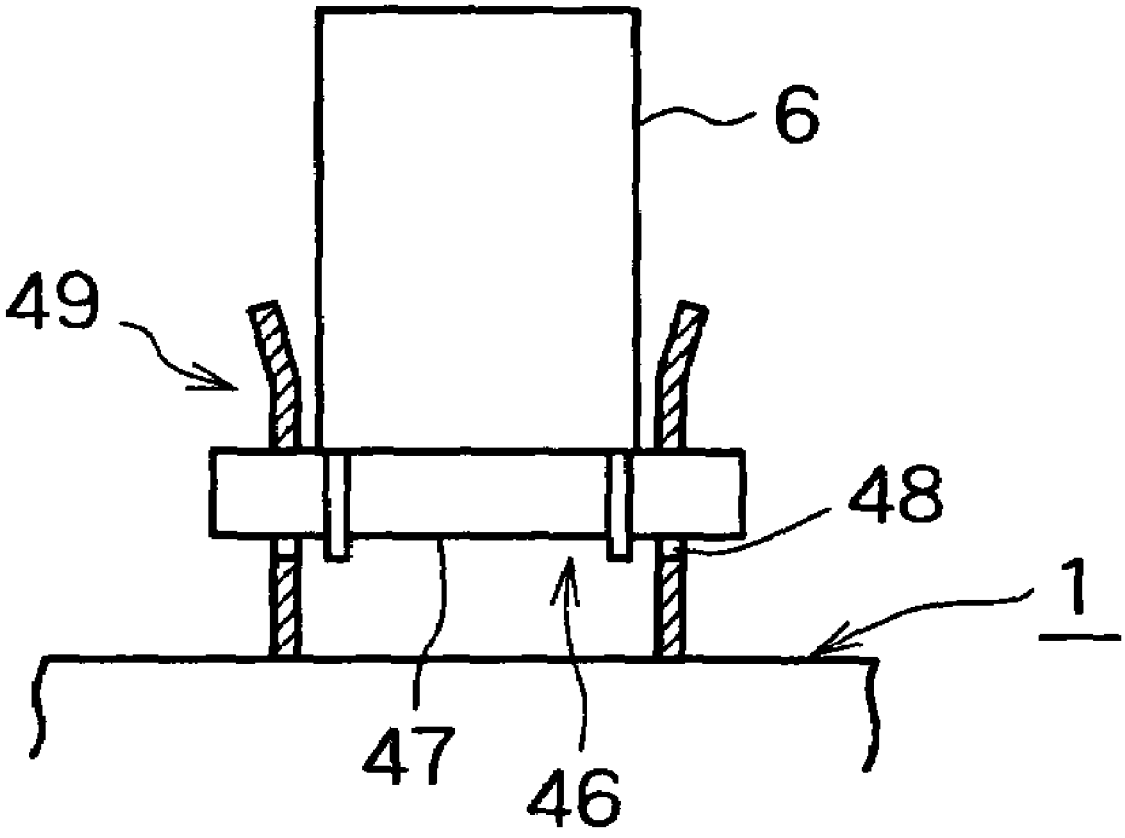
FIG. 17 is a schematic structure explanatory view with attachment fixing means viewed from front.

Further, as shown in FIG. 17, attachment fixing means 46 prevent a rattle in the vertical direction of the extreme end of the boom in the state that the movable frame 9 is most extended and the boom 6 is lowered and most contracted. The attachment fixing means 46 comprises a fixing pin 47 supported on the bracket provided in the width direction of the ventral surface of the extreme end portion of the boom, and a notch 48 whose front portion is opened and the fixing pin 47 is fitted in.

This notch 48 is provided in a boom rest 49 projected at the front upper part of the lower traveling body 1.

Note that structure may be employed which projects an approximately U-shaped fixing bracket having a notch at a position deviated from the boom rest 49. However, preferably the boom rest 49 is normally used for reducing cost.

According to the second embodiment, the following effects can be obtained in addition to those of the first embodiment.

As shown in FIG. 12, when the movable frame 9 is most contracted and the engaging portion 36*a* is stopped at the stop portion 37, an upward moment acting on the movable frame 9 at the time of work is transmitted to the base frame 7 through the engaging portion 36*a* and the stop portion 37. Accordingly, it is possible to prevent excessive force from acting on the upper portion at the rear end of the base frame 7, and therefore the rigidity of the bent portion of the upper portion of the movable frame 9 can be made lower. Because of this, the cost of the movable frame 9 is lower than the first embodiment.

Incidentally, in the second embodiment, the shape of the engaging portion 36*a* is circular, whose deep side is stopped at the stop portion 37 of the semicircular notch. The engaging portion 36*a* may instead be wedge shaped such that the vertical dimension becomes small toward the frame moving cylinder 8, and the stop portion 27 may be a tapered groove-like shape whose vertical width becomes narrow toward the deep side. In doing so, the inclined surface of the engaging portion 36*a* comes into close contact with the inclined surface of the stop portion 37, and therefore it is possible to prevent a rattle of the movable frame 9 more positively, contributing to enhancement of efficiency of the crane work.

Further, since the movable frame 9 is secured to the base frame 7 by the securing means at the time of contraction 38 provided on the side of the base frame 7, the crane vibrates when the crane operates, but the engaging portion 36*a* is not disengaged from the stop portion 37 due to the vibration, and the crane work can be carried out in a stabilized state.

Further, in the travel attitude in which the movable frame 9 is extended, and the boom 6 is lowered and most contracted, the movable frame 9 is secured to the base frame 7 by the securing means 45 at the time of extension provided on the side of the base frame 7.

Further, since the extreme end of the boom 6 is fixed by the attachment fixing means 46, even if the crane is vibrated during traveling, the movable frame 9 is not moved to the base frame 7, or the extreme end of the boom is not possibly shaky vertically. Accordingly, there occurs no possible pitching phenomenon with respect to the crane during traveling due to the causes as described, and the stabilized travel becomes enabled, thus providing a comfortable ride.

Note that in the securing means 45 at the time of extension, safety during traveling can be further enhanced by adding, at the forward open end thereof, structures such as an anti-disengaging mechanism, a difference in level, an anti-slip pin, a locking mechanism by a link-type bracket, an automatic lock by a wire cable or an electric signal, a remote release and the like.

Further, in the first and second embodiments, the sliding pad provided in the base frame 7 and the movable frame 9 is sidably moved by the frame moving cylinder 8, but the moving means of the movable frame 9 with respect to the base frame 7 is not limited to the cylinder. As a moving means other than a cylinder, the movable frame 9 may be moved by a rack and pinion. In this case, a rack is disposed on the ventral surface side of the boom 6, a drive motor provided with a pinion is disposed on the upper surface of the frame of the lower traveling body 1, the boom 6 is lowered to cause the pinion to mesh with the rack, the fixing pin is removed, and the drive motor is driven, whereby the movable frame 9 may be moved together with the boom 6.

Further, as a method for moving the movable frame 9 making use of a separate actuator mounted on the crane, there may be provided a rope which is wound and wound back by means of a winch mounted on the back of the base end of the boom 6.

(1) In case that the movable frame 9 is contracted Sheaves are provided at upper and lower positions of the rear end of the movable frame 9, a rope is stretched over the sheaves, the extreme end of the rope is connected to the base frame 7, and the rope is wound by the winch.

(2) In case that the movable frame 9 is extended

The extreme end of the rope stretched over boom point sheaves at the extreme end of the boom and wound and wound back by the winch is connected to the lower traveling body 1, and the rope is wound by the winch. Note that in another form of the winch driving, the movable frame can be moved in various structures by the course of the rope and the arrangement of the sheaves, such that the sheaves are disposed forward of the basic boom, and the rope end is secured to the rotating frame.

The boom telescoping cylinder is used.

(1) In case that the movable frame 9 is contracted

The boom 6 is extended by the boom telescoping cylinder, a stay is interposed between the extreme end of the boom 6 and the lower traveling body 1, and the boom is contracted by the boom telescoping cylinder.

(2) In case that the movable frame 9 is extended

The stay is interposed between the extreme end of the boom and the lower traveling body 1 to connect them, and the boom 6 is extended by the boom telescoping cylinder. In this case, as the stay for linking the extreme end of the boom and the lower traveling body 1, suitable exclusive-use metal rod, link or the like can be used according to the projecting amount from the front end of the lower traveling body 1 of the boom 6 in the most contracted state of the movable frame, and an attachment such as a jib which is often used for hanging work can be also used.

Third Embodiment

Figure 18:
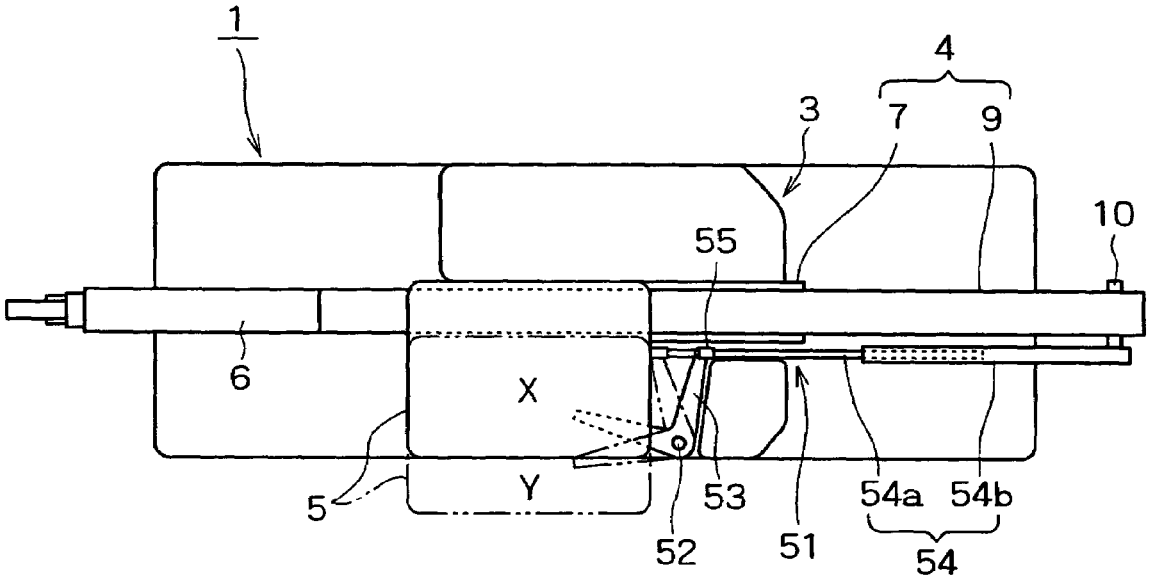
FIG. 18 is a schematic side view of the whole of a self-traveling crane according to a third embodiment of the present invention.

See FIG. 18

Only the difference from the first and second embodiments will be described.

The cabin 5 is supported movably in the width direction by a slide mechanism comprising a guide rail and a guide roller (both of which are not shown) provided between the cabin 5 and the base frame 7, and the lower surface at the rear portion of the cabin 5 and the rear portion of the movable frame 9 are connected by a link mechanism 51.

The link mechanism 51 comprises an L-shaped turning arm 53 provided rotatably around a vertical shaft 52 on the base frame 7 and having one end pin-connected to the lower surface of the cabin through a slot, and a telescoping body 54 provided between the other end of the turning arm 53 and the rear portion of the movable frame 9. The telescoping body 54 is free to telescope in a telescoping manner by a rod 54*a* connected to the turning arm 53 through a pole joint 55, and a tube body 54*b* connected to the movable frame 9.

In the turning center portion of the turning arm 53 is provided a spring (not shown) for biasing the arm 53 to a position shown by the solid line in FIG. 18.

When the movable frame 9 extends and moves when the crane operates, the telescoping body 54 is most contracted in the midst of movement thereof to press the turning arm 53. Thereby, the turning arm 53 turns outward around the vertical shaft 52 as shown by the two-dot contour line in FIG. 18, and the cabin 5 is moved from the width internal position X to the side projecting position Y by the arm turning force.

According to this structure, the cabin 5 moves to the side projecting position Y capable of avoiding interference with the boom 6 in the movable frame contracted state to be a crane working attitude, and therefore a safer mechanical interlock function can be obtained as compared with the case where the cabin 5 is moved by a separate actuator (for example, the cabin moving cylinder 22 in the first embodiment).

Further, since the exclusive-use actuator is not required, the structure can be simplified to reduce the cost.

Figure 19:
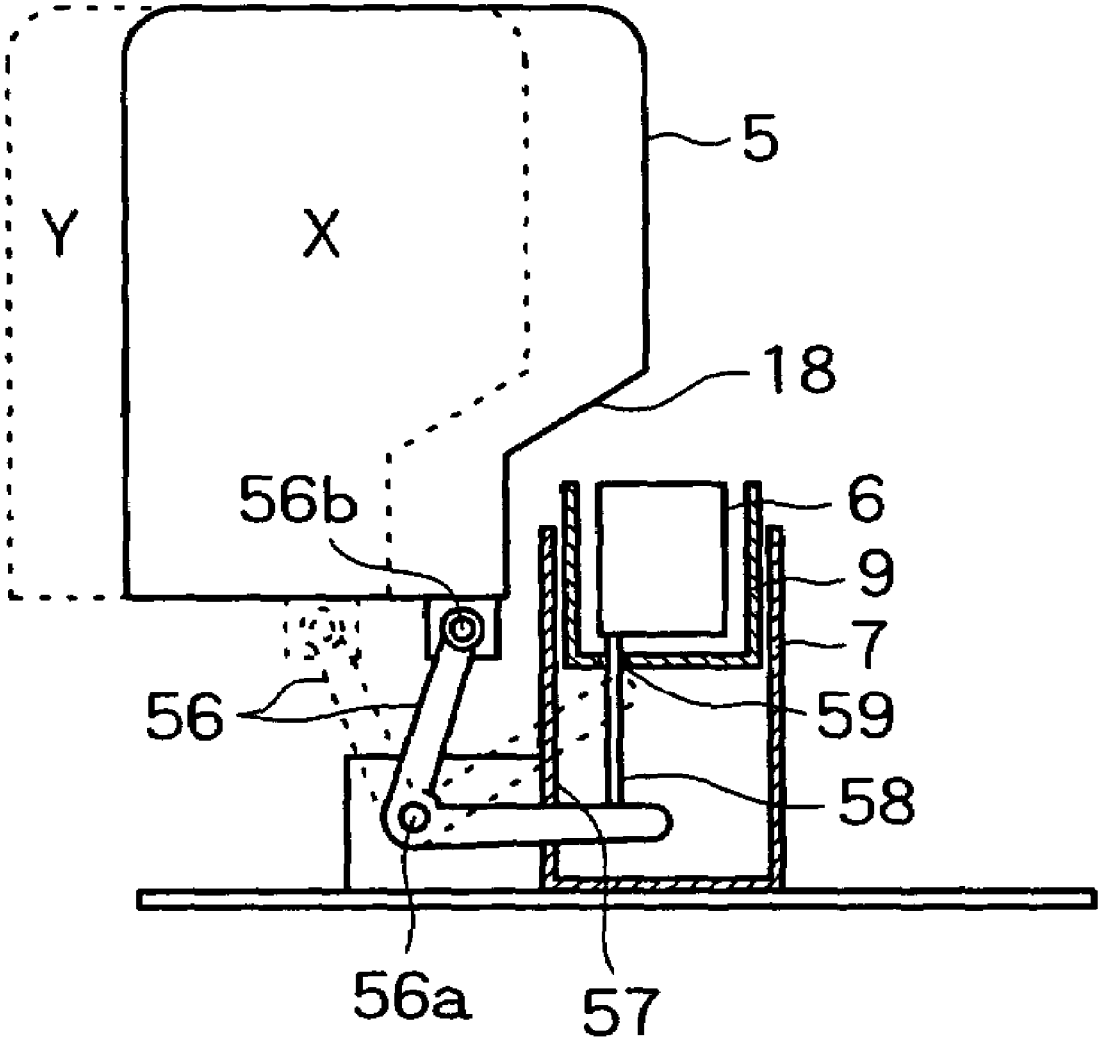
FIG. 19 is a schematic sectional view of an upper traveling body of a self-traveling crane according to a modification of the third embodiment.

As a modification of the third embodiment, as shown in FIG. 19, the cabin 5 may be moved between the width internal position X and the side projecting position Y using the boom falling force and the spring force. That is, similarly to the third embodiment, downwardly of the cabin 5 supported movably in the width direction by the slide mechanism, the L-shaped turning arm 56 is mounted turnably around a horizontal shaft 56*a*, and one end of the turning arm 56 is connected to the lower surface of the cabin through a pole joint 56*b* (in place of which a slot may be used).

The other end of the turning arm 56 passes through a longitudinal slot 57 of the base frame 7 to face to a portion below the movable frame 9, and the extreme end of a pressing rod 58 mounted below the lower surface of the boom 6 is placed in contact with the other end of the turning arm 56. Reference numeral 59 denotes a pressing rod introducing hole provided in the movable frame 9.

In the turning center portion of the turning arm 56 is provided a spring for biasing the arm 56 to a position shown by the broken line (moving the cabin 5 to the side projecting position Y).

Note that the cabin 5 is provided with an recess portion 18 with respect to the boom 6.

Further, as means for securing the cabin 5 to the width internal position X, mutually engaging brackets (not shown) is provided at a position where the cabin 5 and the base frame 7 correspond to each other, and the operation for connecting and releasing the brackets can be carried out within the cabin 5.

Further, preferably, a damper such as hydraulic damper is provided between the turning arm 56 and the base frame 7 in order to carry out the turning motion of the arm caused by the spring force.

In this structure, in the state that the boom 6 is lowered, the rotating arm 56 is held at a position shown by the solid line in the figure by the pressing rod 58, and the cabin 5 is held at the width internal position X. When the boom 6 is erected from that state, the pressing rod 58 rises, and therefore the turning arm 56 is turned to the position indicated by the dashed line by the spring force, and the cabin 5 is extended to the side projecting position. Further, when the boom 6 is lowered, the turning arm 56 is rotated to the solid-line position by the pressing rod 58, and the cabin 5 moves to the width internal position X.

Even by this structure, the basically same effects as the third embodiment can be obtained.

Note that as specific means for making use of a drive force of another actuator for the purpose of automating movement of the cabin, a wire rope, a chain, or a rack and a pinion gear or the like can be used. As the actuator for obtaining the drive force, any other means that is provided on the upper rotating body can be used.

Fourth Embodiment

Figure 20:
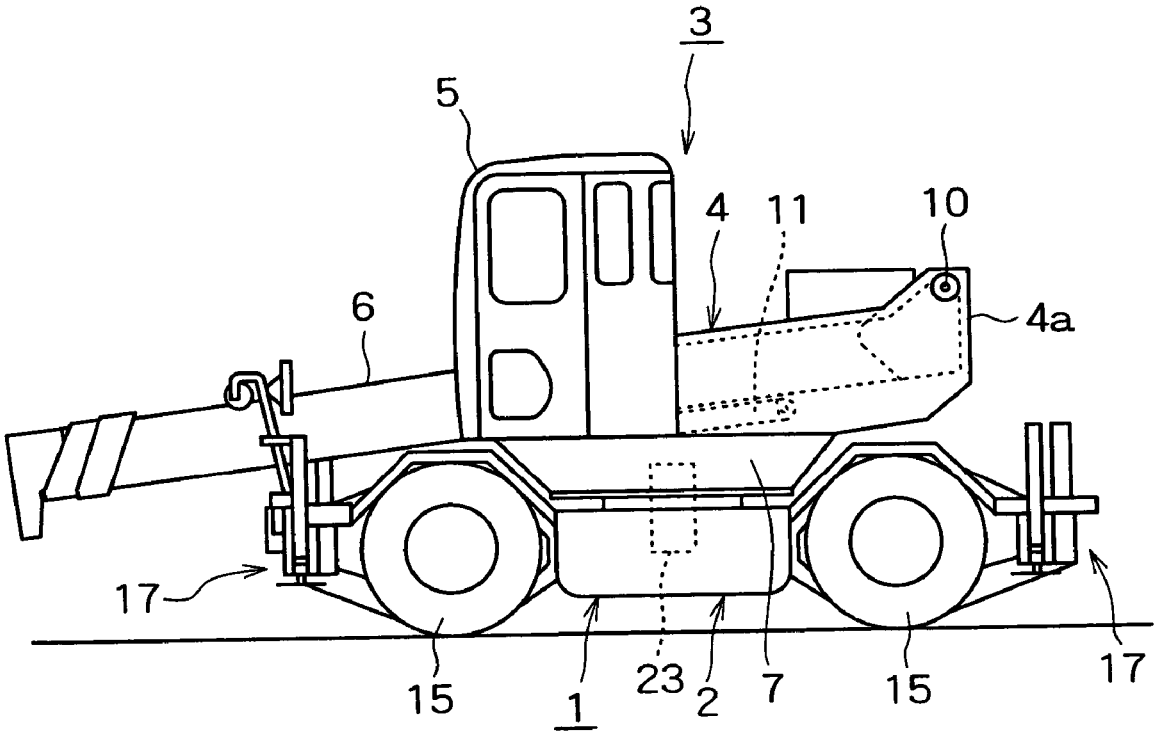
FIG. 20 is a schematic side view of the whole of a self-traveling crane according to a fourth embodiment of the present invention.

See FIG. 20

In the above-described embodiment, the rotating frame 4 comprises the base frame 7 and the movable frame 9, and the boom 6 is mounted on the movable frame 9 (see FIG. 1), whereas in the third embodiment, the boom 6 is supported free to rise/fall through the boom foot pin 10 on the bracket portion 4*a* provided at the upper part at the rear of the integrated type rotating frame 4, similarly to the conventional crane.

Even by this structure, the following effects approximately equal to both the first and second embodiments can be obtained.

(1) The center of gravity of the machine body can be lowered to a lower position at a position close to the center in the width direction of the crane, and therefore the width of the crane can be contracted while securing a tilting angle.

(2) The crane working state can be visually recognized from the side of the lower traveling body 1 by movement of the cabin 5 to the side projecting position Y, and therefore the forward field of view can be enlarged to enhance the efficiency of the crane work.

(3) Since the boom 6 does not possibly interfere with the cabin 5, the damage of the cabin 5 or the boom 6 caused by the interference of the boom 6 can be prevented, and there occurs no trouble in movement in the work site.

Fifth to Seventh Embodiments

See FIGS. 21 to 26

The following the fifth to seventh embodiments are characterized in structure of the lower traveling body 1. However, since the structure of the upper rotating body is the same as the first and second embodiment, illustration and description thereof are omitted, and reference is made to the drawings in the first and second embodiments as necessary.

Fifth Embodiment

Figure 21:
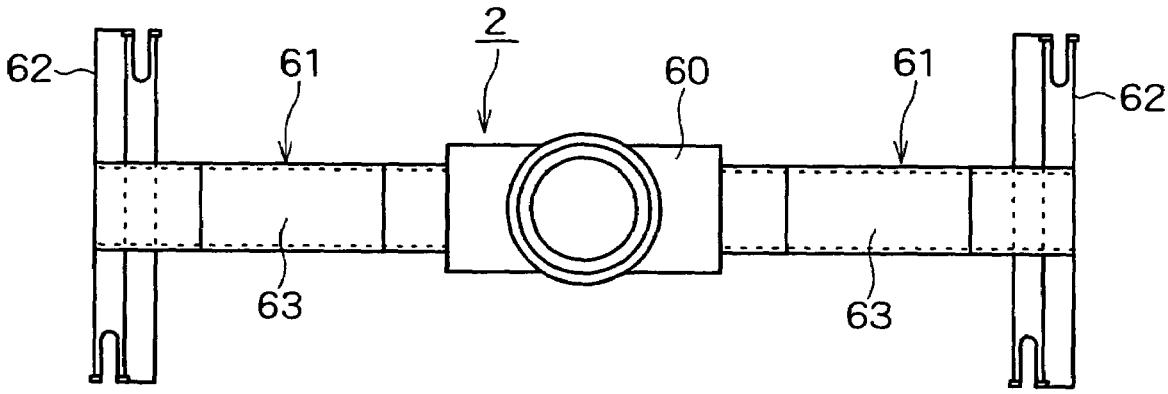
FIG. 21 is a plan view of a traveling frame of a lower traveling body in a self-traveling crane according to a fifth embodiment of the present invention.
Figure 22:
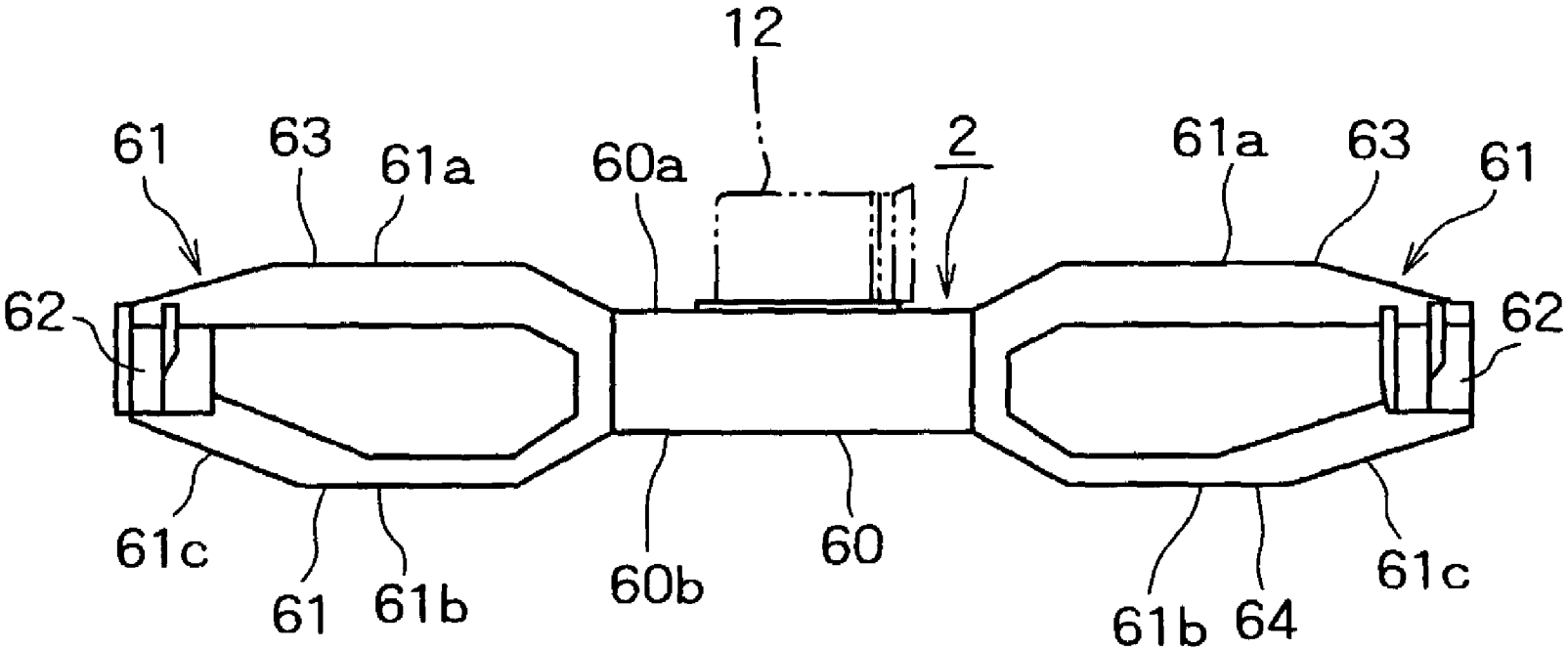
FIG. 22 is a side view of the fifth embodiment of the present invention.

See FIGS. 21, 22

Approximately box-shaped rotating pedestals 60 as rotating base on which an upper rotating body is mounted through a rotating bearing are provided approximately in the center in lengthwise and width directions of the traveling frame 2 of the lower traveling body.

Axle support portions 61 for supporting the axle 16 shown in FIG. 2 are provided on both front and rear sides of the rotating pedestal 60, and the axle support portions 61 forward and rearward the front axle support portion 61 are provided backward thereof with outrigger support portions 62.

As shown in FIG. 22, the upper surface 60*a* of the rotating pedestal 60 is to be positioned at a level lower than the upper surfaces 61*a* of both the axle support portions 61. That is, according to this crane, the upper surface 60*a* of the rotating pedestal 60 for supporting the upper rotating body 3 shown in FIGS. 1, 2 is set to be lower than the case of the conventional crane. Thereby, since the position of the center of gravity of the whole crane can be lowered, travel stability is enhanced.

On the other hand, the lower surface 60*b* of the rotating pedestal 60 is set to a level higher than the lower surfaces 61*b* of both the axle support portions 61 and inclined surfaces 61*c* inclined obliquely upward toward the outside in the lateral direction of the traveling frame 2 are formed at the rear of the lower surfaces 61*b* of both the axle support portions.

Thereby, the lower surface 60*b* of the rotating pedestal 60 of the traveling frame 2 is lowered in center of gravity when the crane travels is not possibly placed in contact with the ground, and therefore there occurs no obstacle in travel, and further when moving into a hill or slope, or moving out of a hill, the lower surface of the axle support portions 61 is not possibly placed in touch with the ground.

Incidentally, the lower surface 60*b* of the rotating pedestal 60 will be higher than the lower surface of both the axle support portions 61. A difference in level between the upper surface 60*a* of the rotating pedestal 60 and the upper surfaces 61*a* of both the axle support portions 61 is preferably large for securing the strength of the rotating pedestal 60.

Both the axle support portions 61 comprise an upper frame member 63 and a lower frame member 64 for sandwiching the axle 16 shown in FIG. 2 in a vertical direction.

Both the upper and lower frames 63, 64 have a cross section of a rectangular closed sectional construction, and a coefficient of section of parts in a lateral direction corresponds to a stress exerted on the parts.

Accordingly, the rigidity of the axle support portions 61 can be enhanced, no possible excess or shortage occurs in the rigidity of parts in the lateral direction of the upper frame member 63 and the lower frame member 64, and the parts are not over-engineered, which is useful for lightening the traveling frame 2.

Further, both outrigger support portions 62 are supported while being sandwiched in the direction perpendicular to the lateral direction of the traveling frame 2 by the upper frame member 63 and the lower frame member 64. Accordingly, the outrigger device 17 shown in FIGS. 1, 2 can be supported with high strength, and the rigidity of both upper and lower frame members 63 is also enhanced, therefore contributing to a reduction in vibration during traveling, and safety during crane traveling.

Further, similarly to the first embodiment, the engine 12 shown in FIG. 2 is mounted on the upper rotating body 3 so that an engine mounting section need not be provided on the traveling frame 2, and therefore the traveling frame 2 can be made compact. Further, since the position of the upper rotating body 3 is also lowered, the position of the center of gravity of the whole crane can be lowered.

Further, the upper surface 60*a* of the rotating pedestal 60 is low and positioned at a level lower than the upper end of the axle as described above, and therefore a heavy article may be put on the upper rotating body 3 above the rotating pedestal 60 as shown by the two-dot contour line in FIG. 22.

While in the figure, the engine 12 is illustrated as the heavy article, the working oil tank 13 shown in FIG. 2 or a fuel tank (not shown) may be installed. In doing so, the whole crane can be further lower the center of the gravity.

It is preferable that the center of rotating is arranged in the vicinity of a central portion of the wheel base (between axles). In doing so, the heavy article can be arranged most efficiently.

Sixth Embodiment

Figure 23:
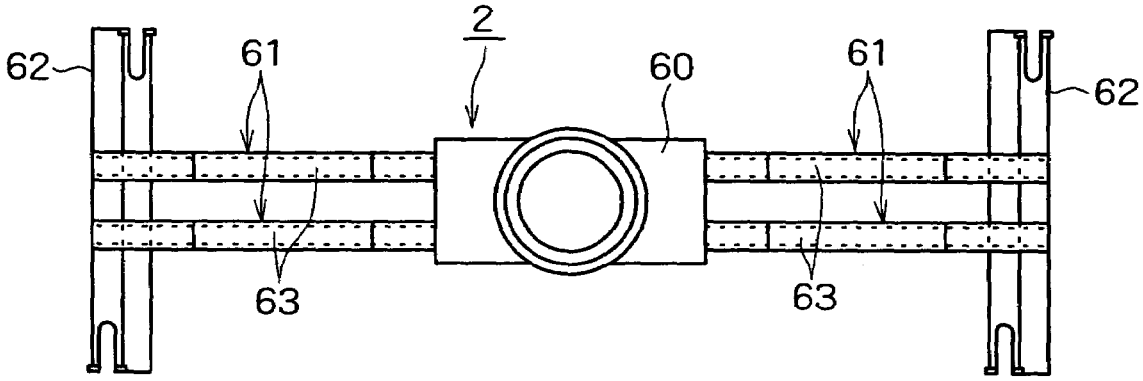
FIG. 23 is a plan view of a traveling frame of a lower traveling body in a self-traveling crane according to a sixth embodiment of the present invention.
Figure 24:
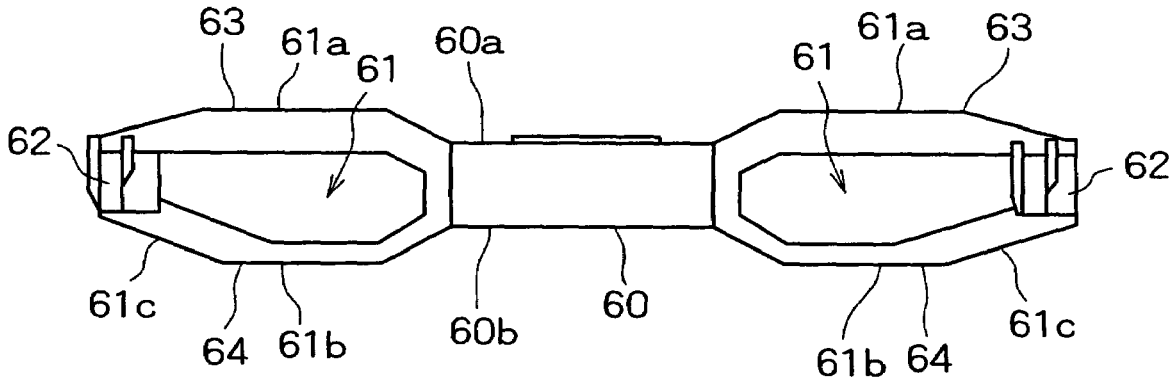
FIG. 24 is a side view of the sixth embodiment of the present invention.

See FIGS. 23, 24

In the sixth embodiment, the construction of both axle support portions 61, 61 of the traveling frame 2 are different from the fifth embodiment.

Only the aforementioned different portion will be described. As shown in FIG. 23, upper and lower frame members 63, 64 of both axle support portions 61 are divided into two (left and right). According to this structure, in addition to the effects of the fifth embodiment, machines and tools such as a valve, pipe lines, electric wires and the like can be disposed in a space formed in the upper and lower frame members 63, 64, thus contributing to the enhancement of the disposing space for these machines and tools, pipelines, electric wires and the like.

Further, the frame members 63, 64 divided into two (left and right) will be the construction for connecting left and right parts of the outrigger support portion 62, thus being advantageous with respect to strength against twisting.

Seventh Embodiment

Figure 25:
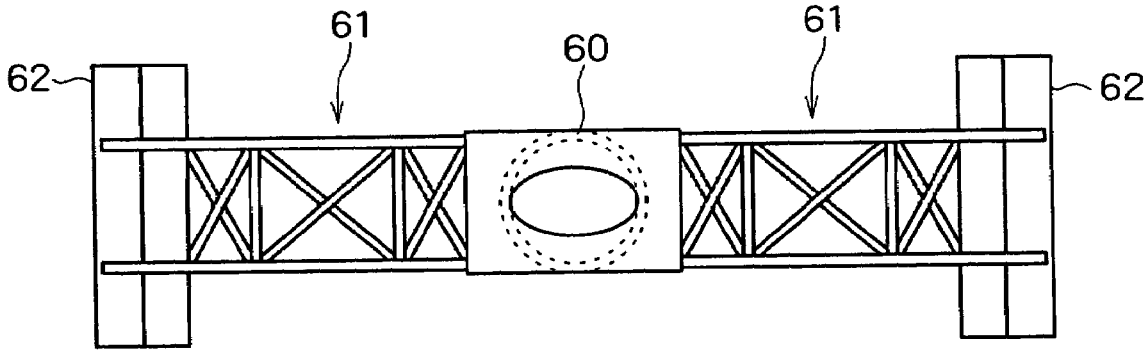
FIG. 25 is a plan view of a lower traveling body in a self-traveling crane according to a seventh embodiment of the present invention.
Figure 26:
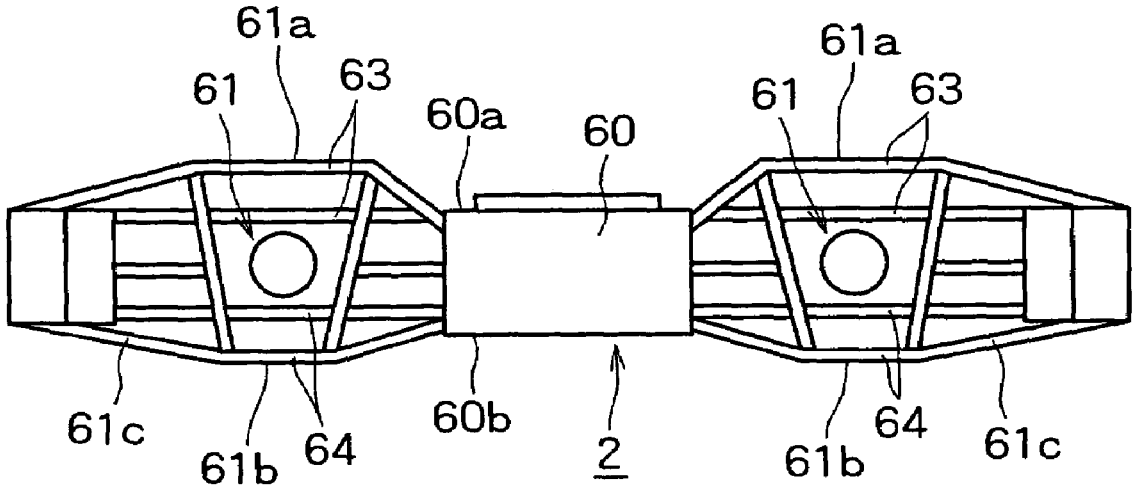
FIG. 26 is a plan view of the seventh embodiment of the present invention.
Figure 27:
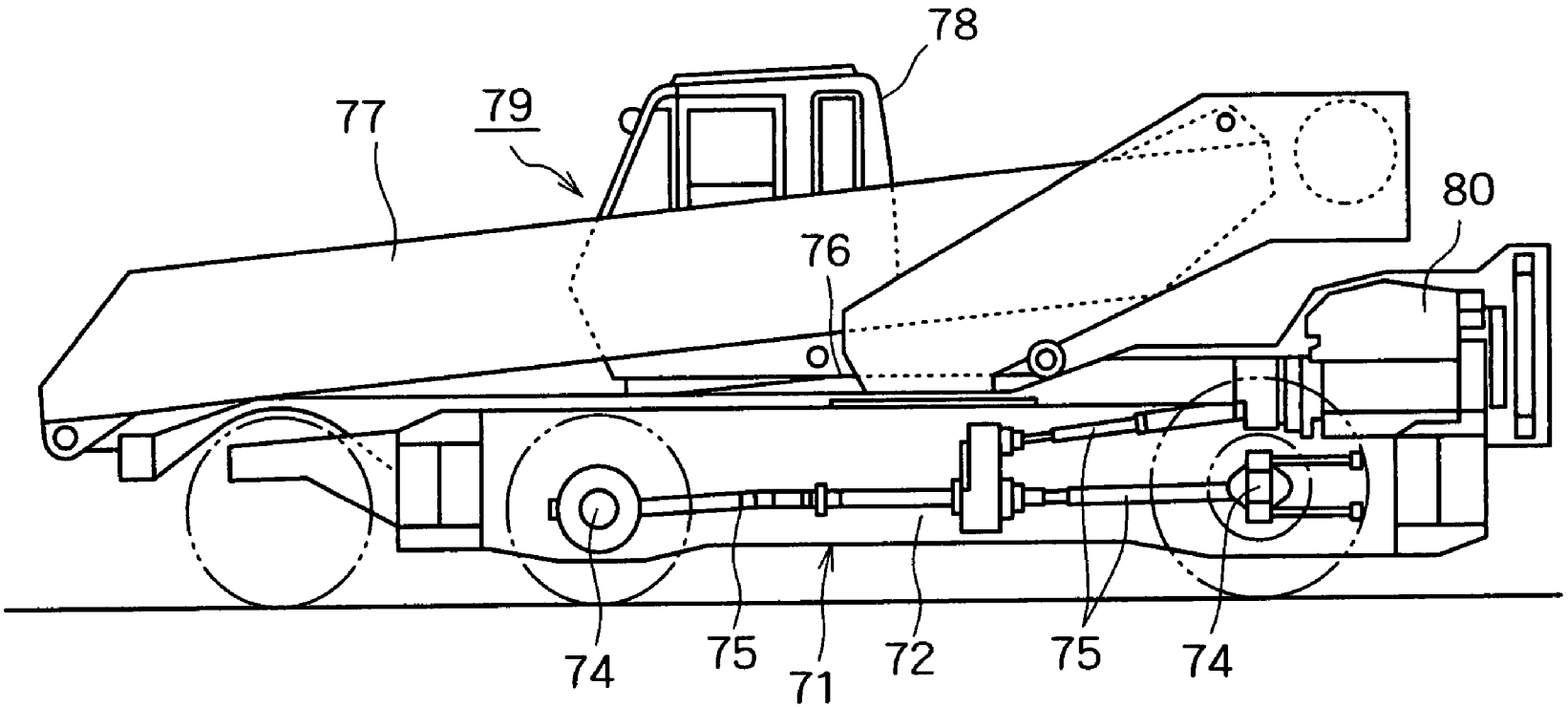
FIG. 27 is a schematic side view of the whole showing a conventional self-traveling crane.
Figure 28:
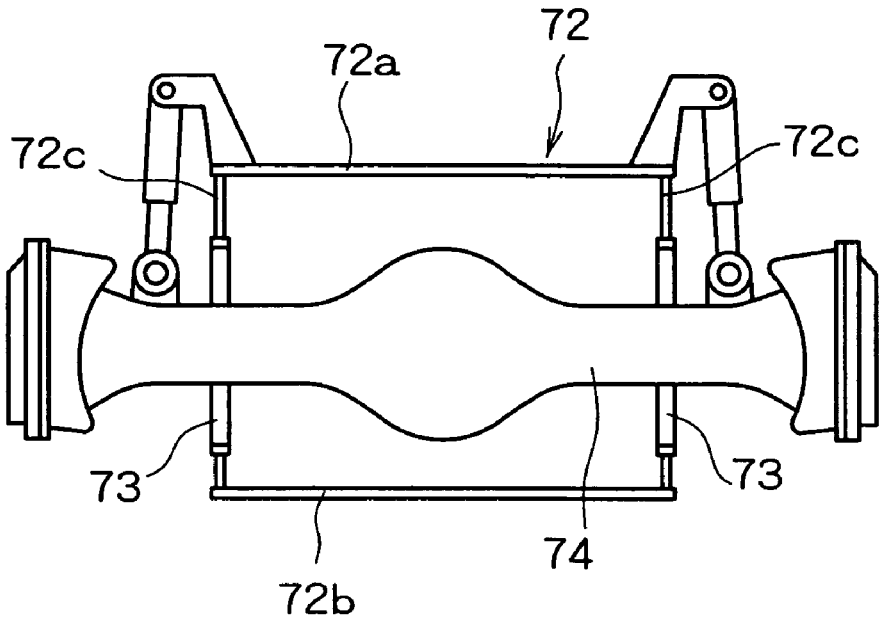
FIG. 28 is a front view showing a positional relation between a traveling frame and an axle in the crane.
Figure 29:
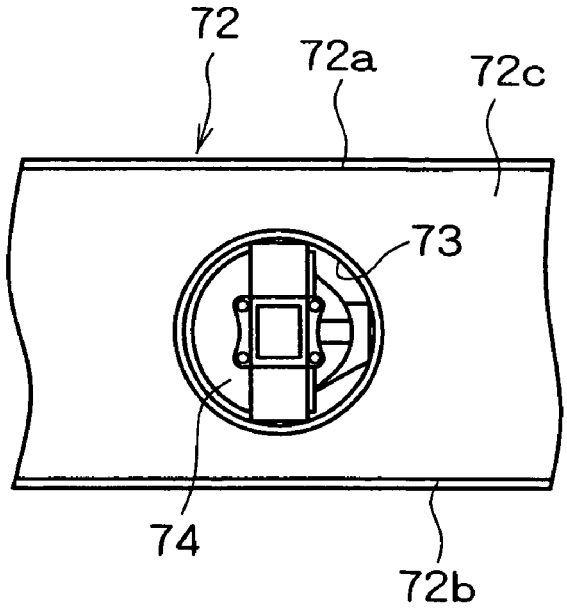
FIG. 29 is a side view of the same.

See FIGS. 25, 26

In the seventh embodiment, both axle support portions 61, 62 of the traveling frame 2 are of a lattice construction comprising steel pipes. As described, even if both the axle support portions 61, 62 are changed to a lattice construction, the effects equal to the fifth and sixth embodiments can be obtained.

As described above, according to the present invention, the working attachment is arranged so as to transversely extend at a lower side of the cabin when the self-traveling working machine travels. Therefore, the position of the center of gravity of the self-traveling working machine can be lowered, in addition the working attachment can be moved close to the center of the machine width by an amount that the working attachment is superposed to the cabin, thus enabling contraction of the width of the self-traveling machine by the amount superposed to the cabin.

Further, according to the present invention, in the self-traveling working machine in which the rotating pedestal is provided in the vicinity of a central portion of the traveling frame of the self-traveling working machine, and the axle support portions are provided on both front and rear sides of the rotating pedestal, the upper surface of the rotating pedestal is lower than the upper surface of both the axle support portions, thus enabling lowering the upper surface of the rotating pedestal for supporting the upper rotating body as compared to the prior art. Therefore, it is possible to lower the center of gravity of the machine body and enhance traveling safety.

Furthermore, according to the present invention, in the self-traveling working machine provided with a lengthy working attachment as in the multi-step telescopic boom, it is possible to make the body longer and make the weight lighter without impairing the narrow moving-in property and narrow working property by the working attachment and without increasing the number of stages of the working attachment.

The invention claimed is:

1. A self-traveling working machine comprising:

a lower traveling body;

an upper rotating body rotatably mounted on the lower traveling body and having a rotating frame; and a cabin;

a boom mounted on the rotating frame of the upper rotating body so as to be able to be raised and lowered from and to a maximum lowered state, wherein said boom, when at the maximum lowered state, extends laterally to a lower side of said cabin, wherein at least a part of said cabin is superposed to an upper surface of said boom in said maximum lowered state; and interference avoiding means for avoiding interference of the cabin with the boom when the working attachment is raised and lowered.

2. The self-traveling working machine according to claim 1, wherein said boom is disposed on said rotating frame at an approximately central position in a width direction of said lower traveling body.

3. The self-traveling working machine according to claim 1, wherein the cabin includes a recess for accommodating said boom at its maximum lowered state.

4. The self-traveling working machine according to claim 1, wherein said interference avoiding means includes cabin moving means for moving said cabin between an internal position positioned within a width of said lower traveling body and a side projecting position projecting outside the width on said rotating frame.

5. The self-traveling working machine according to claim 4, further including means for limiting a raising and lowering of said boom when said cabin is at said internal position.

6. The self-traveling working machine according to claim 4, further including means for limiting traveling of said lower traveling body when said cabin is at said side projecting position.

7. The self-traveling working machine according to claim 1, wherein said boom is mounted to be movable backward and forward, and wherein the working machine further comprises drive means for backward and forward moving said boom.

8. The self-traveling working machine according to claim 1, further comprising an engine mounted on said rotating frame.

9. The self-traveling working machine according to claim 8, wherein said engine is arranged on a first side of said rotating frame, and said cabin is arranged on a second side of said rotating frame.

10. A self-traveling working machine comprising:

a lower rotating body;

an upper rotating body rotatably mounted on the lower traveling body and having a rotating frame;

a cabin;

a telescoping boom pivotally mounted on the rotating frame of the upper rotating body so as to be able to be raised and lowered from and to a maximum lowered state, wherein the boom is arranged to extend fore-aft of the rotating frame and to pass laterally to a side of the cabin in the maximum lowered state of the boom, wherein said rotating frame has a base frame connected to said lower traveling body and a movable frame mounted to move in a backward and forward direction with respect to the base frame, and the movable frame has a fulcrum for raising and lowering said boom, wherein the fulcrum is located rearward from a rear end of said base frame.

11. The self-traveling working machine according to claim 10, wherein an engaging portion projecting outward from a side thereof is provided on said movable frame, and a stop portion adapted to keep said engaging portion in a fixed state when said movable frame is most contracted and said engaging portion is engaged with the stop portion, is provided on a rear end portion of said base frame.

12. The self-traveling working machine according to claim 10, further comprising contracted time fixing means for fixing the movable frame in a most contracted state to said base frame, and extended time fixing means for fixing the movable frame in a most extended state to said base frame.

13. The self-traveling working machine according to claim 10, further comprising attachment fixing means for fixing the boom in a state that said movable frame is most extended and said boom is most contracted provided on the lower traveling body.

14. The self-traveling working machine according to claim 10, wherein the fulcrum for raising and lowering said boom is positioned below an approximately central position in a height direction of said cabin.

15. The self-traveling working machine according to claim 10, further comprising a power unit including an engine mounted on said base frame, and the fulcrum for raising and lowering said boom is movable to a position projecting rearward from a rear end of said lower traveling body.

16. The self-traveling working machine according to claim 10, wherein said boom is mounted to be lower from rearward to forward in its lowermost state.

17. The self-traveling working machine according to claim 10, wherein said boom is arranged obliquely to be lower from rearward to forward in its lowermost state, and the movable frame is movable in an inclined direction of said boom.

* * * * *